US008183450B2

(12) United States Patent
Yoshino et al.

(10) Patent No.: US 8,183,450 B2
(45) Date of Patent: May 22, 2012

(54) PERCUSSION INSTRUMENT SYSTEMS AND METHODS

(75) Inventors: Kiyoshi Yoshino, Hamamatsu (JP); Hidekazu Higuchi, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 12/685,987

(22) Filed: Jan. 12, 2010

(65) Prior Publication Data

US 2010/0313732 A1 Dec. 16, 2010

(30) Foreign Application Priority Data

Jun. 10, 2009 (JP) ..... 2009-139243

(51) Int. Cl.
*G10D 13/02* (2006.01)

(52) U.S. Cl. ..... 84/411 R

(58) Field of Classification Search ..... 84/411 R, 84/413, 321
See application file for complete search history.

(56) References Cited

U.S. PATENT DOCUMENTS

| | | | | |
|---|---|---|---|---|
| 4,206,681 | A * | 6/1980 | Kluczynski et al. | 84/411 R |
| 4,242,937 | A * | 1/1981 | Pozar | 84/725 |
| 4,869,146 | A | 9/1989 | Bonsor | |
| 5,461,959 | A * | 10/1995 | Sassmannshausen et al. | 84/421 |
| 2008/0168886 | A1 | 7/2008 | Neumayer et al. | |

FOREIGN PATENT DOCUMENTS

| | | |
|---|---|---|
| JP | S59-069794 | 4/1984 |
| JP | H05-073694 | 10/1993 |

OTHER PUBLICATIONS

English translation for Japanese patent application No. JP S59-069794.
Machine translation for Japanese patent application No. JP H05-073694.

* cited by examiner

*Primary Examiner* — Kimberly Lockett
(74) *Attorney, Agent, or Firm* — Foley & Lardner LLP

(57) ABSTRACT

A percussion instrument may have a hoop member configured to hold down a head stretched across a first end of the shell by a plurality of adjustment devices that may be for operatively connecting the hoop member with a plurality of fixtures that may be arrangeable along at least two surfaces of the shell.

31 Claims, 7 Drawing Sheets

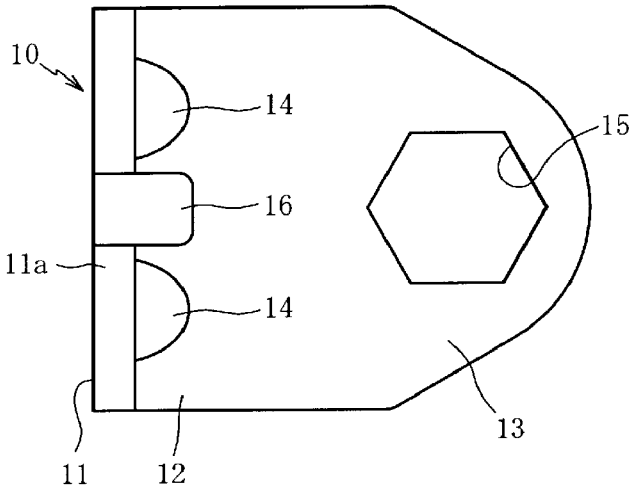
Fig. 3(a)
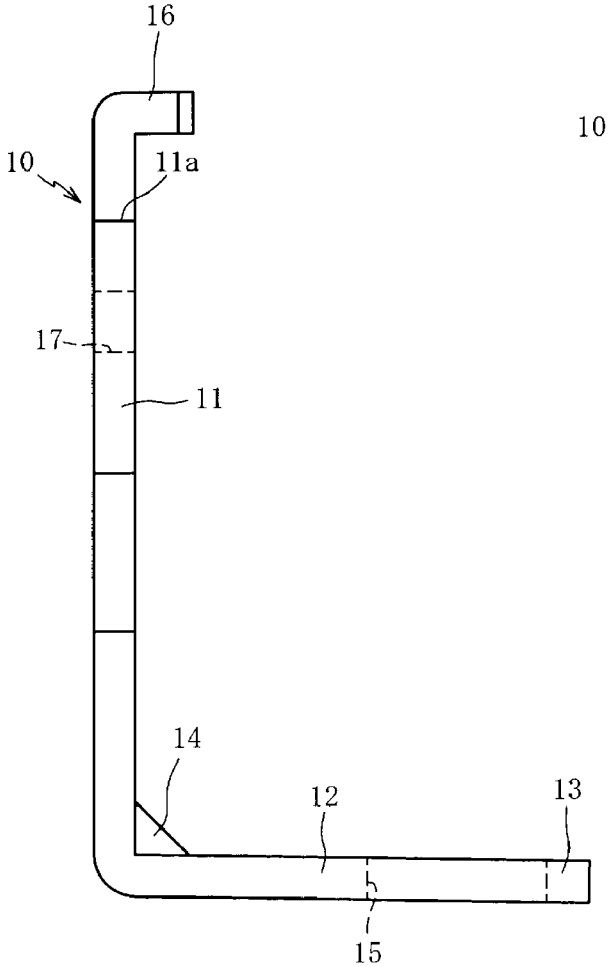
Fig. 3(b)
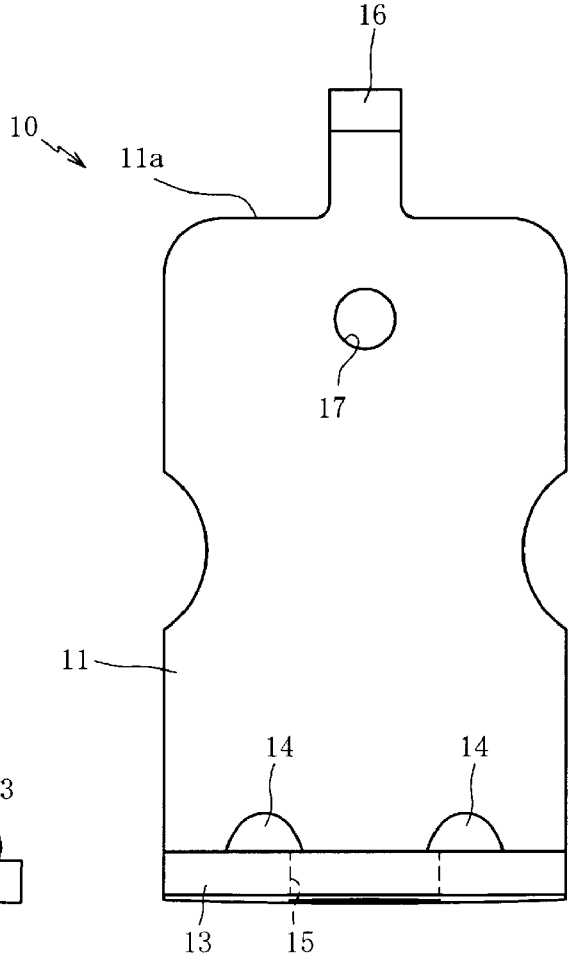
Fig.(3c)

PERCUSSION INSTRUMENT SYSTEMS AND METHODS

CROSS-REFERENCE TO RELATED PATENT APPLICATIONS

Japan Priority Application 2009-139243, filed Jun. 10, 2009 including the specification, drawings, claims and abstract, is incorporated herein by reference in its entirety.

BACKGROUND

1. Field of the Invention

Embodiments of the present invention generally relate to percussion instruments, and, in specific embodiments, to drums having improved weight properties.

2. Related Art

Typically, a drum includes a shell (or body) with a head (or membrane) placed over one or more ends of the shell. An outer peripheral edge of the head is held against the shell with a hoop. The hoop is clamped to the shell with bolts or the like along the axial direction of the shell. Accordingly, the head is stretched and a specified tensile force can be applied to the head.

Other drums include additional hardware (e.g., lugs) attached to an outer peripheral edge of the shell to allow the hoop member to be clamped accordingly. However, drums that include such hardware do not allow the shell of the drum to vibrate as easily as other drums, thus affecting the volume and timbre of the drum.

Japanese Laid-Open Patent Application Publication (Kokai) Number S59-69794 eliminates the use of lugs along the outer peripheral surface of the shell of the drum by including a ring placed around the shell. The ring has a diameter that is roughly equal to a diameter of the shell and is placed around a bottom end of the shell. The outer periphery of the ring includes a plurality of pipe-shaped nuts extending from the ring. A clamping bolt is fastened through the hoop into the pipe-shaped nuts to screw the hoop to the pipe-shaped nuts. As such, the head is stretched and a tensile force is applied to the head.

However, in such a configuration, a large force acts on the portion on which the pipe-shaped nuts are supported. This bends or stretches the portion rendering the application of the tensile force to the head impossible. To prevent this, the ring and the portion on which the pipe-shaped nuts are supported must be strong and not likely to break. Specifically, the portion on which the pipe-shaped nuts are supported requires a large mechanical strength. Accordingly, the mass of the ring and the portion on which the pipe-shaped nuts are supported must be large, which increases the weight of the drum.

SUMMARY OF THE DISCLOSURE

A drum may include, but is not limited to, a tubular shell, a head, a hoop, a plurality of fixing devices, and a plurality of coupling devices. The head may be stretched across a first end of the shell. The hoop may be configured to hold down an outer peripheral edge of the head. The plurality of fixing devices may be arranged along a second end of the shell. The plurality of coupling devices may be for operatively connecting the plurality of fixing devices with the hoop. The plurality of coupling devices may be configured to stretch the head.

Each of the plurality of fixing devices may include a wall, a base, and an extension. The wall of the fixing device may be fixed to a wall section of the shell. The base of the fixing device may protrude from the wall of the fixing device. The base of the fixing device may be arranged adjacent the second end of the shell. The extension of the fixing device may extend from the base of the fixing device so as to extend beyond an outer periphery of the shell. The extension of the fixing device may be operatively connected with an end of a respective coupling device of the plurality of coupling devices.

In such embodiments, the tensile force on the plurality of fixing devices arranged on the shell may be dispersed, and the head can be stretched. Thus, the fixing devices can be attached to the shell without using a strong, rigid ring like in the prior art, which may not break or otherwise become deformed, and may increase the weight of the drum. Thus, in addition, omission of the ring may reduce a weight of the drum.

Moreover, because the extension of the fixing device extends beyond the outer periphery and is operatively connected with the hoop member via the coupling device, tensile force may be applied to the head without attaching lugs or the like to the outer peripheral surface of the shell. In addition, because the base of the fixing device may be arranged adjacent the second end of the shell and the shell is sandwiched between the fixing device and the hoop, the hoop may be pulled toward the fixing device along the axial direction of the shell to stretch the head.

In various embodiments, the wall of the fixing device may be in contact with an inner peripheral surface of the shell.

In such embodiments, the wall of the fixing device may not be visible from the outer peripheral surface of the shell, which may provide a better appearance of the shell. In addition, because the wall of the fixing device and the base of the fixing device are arranged adjacent the inner peripheral surface of the shell and the second end of the shell, respectively, and only the extension of the fixing device extends beyond the outer periphery of the shell, a bending force on the extension of the fixing device may not bend the extension of the fixing device easily. Thus, a smaller and/or lighter fixing device than previously used may be employed while still providing similar holding and/or coupling characteristics with the coupling device. As such, a weight of the fixing device, and thus the drum may be reduced.

In various embodiments, the fixing device may have an attachment hole in the wall for receiving a fastening member. The fixing device may have a locking arm insertable into a specified location of the shell. The shell may have an insertion hole of a location aligned with the attachment hole of the fixing device in a case where the fixing device is arranged on the shell. The shell may have a locking aperture into which the locking arm of the fixing device is insertable.

In such embodiments, the fixing device may include a locking arm formed on the wall of the fixing device, and the shell may include a locking aperture aligned with the locking arm into which the locking arm may be fit. Accordingly, the fixing device can be positioned easily when the wall of the fixing device is attached to or otherwise arranged on the shell.

In addition, because the base of the fixing device may be arranged on the second end of the shell, the fixing device may be constrained at the base and at the locking arm, which may prevent substantial movement of the fixing device when the fastener is inserted into the insertion hole and the attaching hole to attach the fixing device to the shell.

In various embodiments, at least one of the extension of the fixing device and the respective coupling device may have an attachment hole. The drum may further include an insertion member and a fall-out prevention member. The other of the at least one of the extension of the fixing device and the respective coupling device may include the insertion member. The insertion member may be provided in the attachment hole. The fall-out prevention member may have a diameter that gradually increases in an axial direction from the insertion member. The fall-out prevention member may have a diameter greater than a diameter of the attachment hole. A space may be provided between the insertion member and an edge defining the attachment hole of the fixing device in a direction perpendicular to an axial direction of the shell. The respective coupling device may be configured to be fastened to the hoop by rotation of a threaded rod.

In such embodiments, in a case where the rod member is adjusted, for example, to stretch the head, the space may allow the insertion member and the threaded rod to retain a common axis while an angle of the extension of the fixing device relative to the insertion portion changes from the force of the coupling device acting upon it. That is, the insertion portion may be allowed to move along the attachment hole of the fixing device while retaining a common axis with the threaded rod as the threaded rod is adjusted. Such embodiments, for example, may reduce a force acting on the threaded rod in a direction perpendicular to the axis of the threaded rod. Accordingly, excessive force may not be required to attach and detach the threaded rod, thus simplifying the attachment and removal process. In addition, such embodiments may reduce damage to threads on the threaded rod and/or improve durability of the coupling device.

In various embodiments, the drum may further include a cover for covering the second end of the shell, the base of the fixing device, and the extension of the fixing device. The cover may be made of a flexible material.

Accordingly, vibration of the fixing device fixed to the second end of the shell may be reduced, which may substantially prevent a change in a timbre of the drum. In particular embodiments, the cover may suppress vibration of the fixing device, which may reduce vibration transmitted to the coupling device.

A percussion instrument may include, but is not limited to, a shell, a head, a hoop member, a plurality of fixtures, and a plurality of adjustment devices. The head stretched across a first end of the shell. The hoop member may be configured to hold down the head. The plurality of fixtures may be arrangeable along at least two surfaces of the shell. The plurality of adjustment devices may be configured to stretch the head, each of the plurality of adjustment devices for operatively connecting one of the plurality of fixtures with the hoop member.

In various embodiments, each of the plurality of fixtures may include a wall, a base, and an extension. The wall of the fixture may be arrangeable adjacent the shell. The base of the fixture may protrude from the wall of the fixture. The base of the fixture may be arrangeable adjacent the second end of the shell. The extension of the fixture may extend from the base of the fixture beyond an outer periphery of the shell. The extension of the fixture may be for operatively connecting with one of the plurality of adjustment devices.

In some embodiments, the base of the fixture may be substantially perpendicular to the wall of the fixture. In some embodiments, the wall of the fixture may be in contact with an inner peripheral surface of the shell in a case where the fixture is arranged on the shell. In some embodiments, the percussion instrument may include a cover for covering the second end of the shell, the base of the fixture, and a portion of the extension of the fixture. In further embodiments, the cover may be made of a flexible material.

In some embodiments, the wall of the fixture may comprise a first wall. The fixture may further include a second wall extending from the extension. The second wall of the fixture may be operatively connected with the adjustment device. In further embodiments, at least one of the second wall of the fixture and the adjustment device may have an attachment hole. The other of the at least one of the second wall of the fixture and the adjustment device, relative to the at least one of the second wall of the fixture and the adjustment device, may have an arm insertable in the attachment hole to connect the adjustment device with the fixture.

In some embodiments, the wall of the fixture may be in contact with an outer peripheral surface of the shell in a case where the fixture is arranged on the shell. The base of the fixture may extend in a direction away from the outer peripheral surface of the shell. The extension of the fixture may extend away from the base of the fixture in a direction substantially opposite from the base. In further embodiments, the wall of the fixture may be arranged in a recess provided on the outer peripheral surface of the shell.

In various embodiments, at least one of the fixture and the shell may have a locking aperture. At least one of the fixture and the shell may have a locking member insertable into the locking aperture. In various embodiments, the fixture may be configured to be attached to the shell. In some embodiments, the shell may have an insertion hole. The fixture may have an attachment hole aligned with the insertion hole of the shell in a case where the fixture is arranged on the shell. The percussion instrument may further include a fastening member insertable into the insertion hole of the shell and the attachment hole of the fixture to attach the fixture to the shell.

In various embodiments, the adjustment device may include an adjustable rod member for stretching the head. In various embodiments, at least one of the fixture and the adjustment device may have an attachment hole. The other of the at least one of the fixture and the adjustment device, relative to the at least one of the fixture and the adjustment device, may have a portion configured to be retained in the attachment hole. The percussion instrument may further include a fastening member fastened to the portion of the other of the at least one of the fixture and the adjustment device to retain the portion of the at least one of the fixture and the adjustment device in the attachment hole.

In some embodiments, the fastening member may have a head portion with a diameter greater than a diameter of the attachment hole. In some embodiments, the fixture may have the attachment hole. A space may be provided between the insertion member and an edge defining the attachment hole of the fixture in a direction perpendicular to an axial direction of the shell.

In various embodiments, the percussion instrument may further include a frame and a sensor. The frame may be provided in the shell. The sensor may be arranged on the frame to sense a vibration on the head. In various embodiments, the at least two surfaces may comprise a bottom surface of the shell and one of an inner peripheral surface and an outer peripheral surface of the shell.

A method of manufacturing a percussion instrument may include, but is not limited to, any one or combination of: (i) providing a shell; (ii) stretching a head across a first end of the shell; (iii) configuring a hoop member to hold down the head; (iv) arranging a plurality of fixtures along at least two surfaces of the shell; and (v) providing a plurality of adjustment devices configured to stretch the head, each of the plurality of adjustment devices for operatively connecting one of the plurality of fixtures with the hoop member.

BRIEF DESCRIPTION OF THE DRAWINGS

FIG. 3(*a*) is a planar view of a fixing device according to an embodiment of the present invention;

FIG. 3(*b*) is another planar view of a fixing device according to an embodiment of the present invention;

FIG. 3(*c*) is another planar view of a fixing device according to an embodiment of the present invention;

FIG. 5(*b*) is a partial cross-section view of a portion of a fixing device and a portion of a coupling device along the line Vb-Vb of FIG. 5(*a*) according to an embodiment of the present invention;

FIG. 7(*b*) is a cross-section view of a percussion instrument according to an embodiment of the present invention.

DETAILED DESCRIPTION

Figure 1:
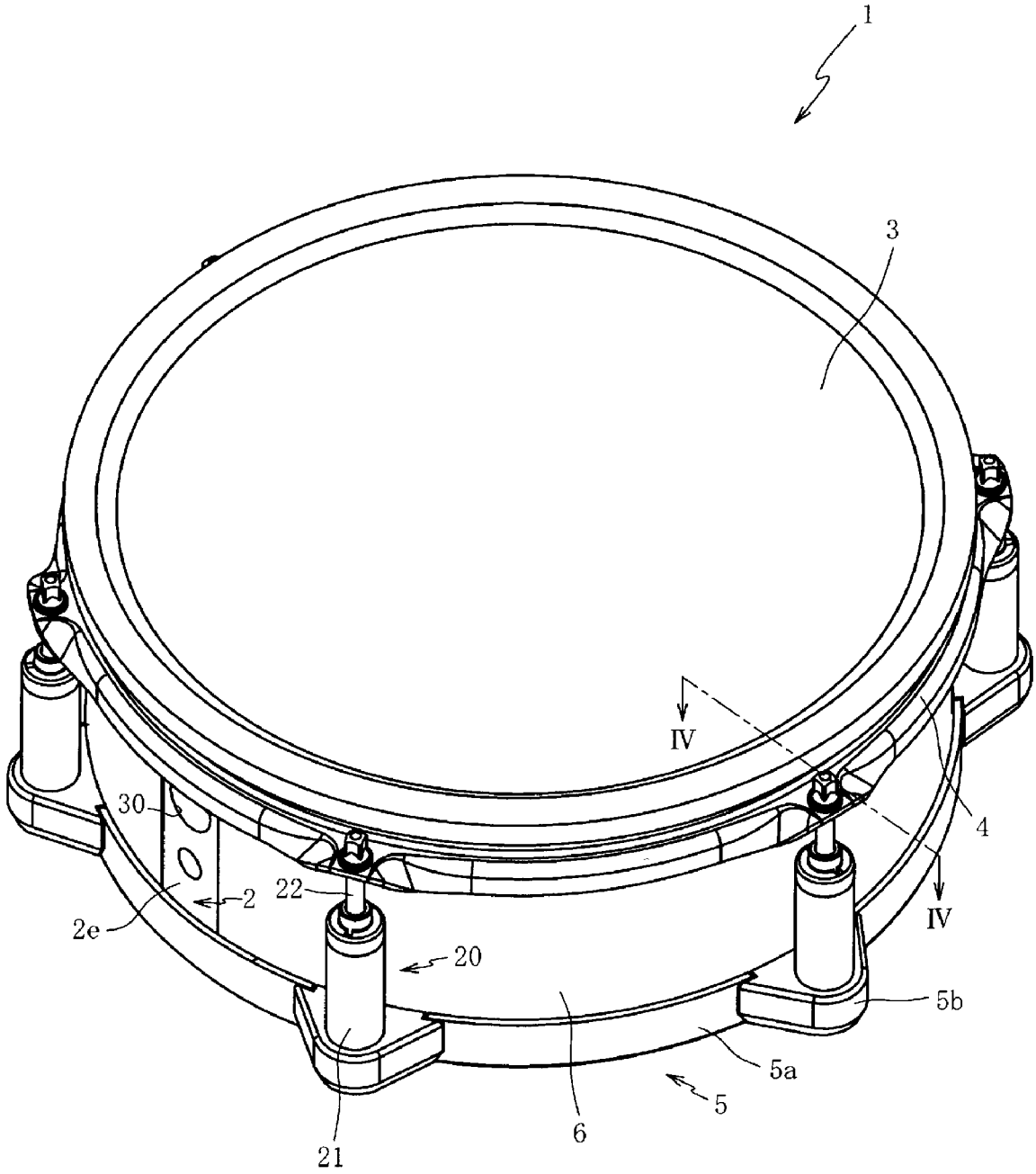
FIG. 1 is a perspective view of a percussion instrument according to an embodiment of the present invention.

FIG. 1 is a perspective view drawing of a percussion instrument according to an embodiment of the present invention. The percussion instrument may be a drum 1, or the like. The drum 1 may comprise a shell (or body) 2, a head (or membrane) 3, a hoop member 4, a plurality of fixing devices (or fixtures) 10 (e.g., FIG. 2), and a plurality of coupling devices (or adjustment devices) 20. Reference may be made to an individual fixing device 10 and/or an individual coupling device 20 as applying to all other fixing devices of the plurality of fixing devices 10 and/or all other coupling devices of the plurality of coupling devices 20, respectively, unless otherwise noted.

The head 3 may be stretched across a first end 2*b* (e.g., FIG. 2) of the shell 2 to provide a striking surface. In some embodiments, the head 3 may be made of (but not limited to) a flexible material, such as a soft synthetic resin, an elastomer, rubber, and/or the like. In other embodiments, the head 3 may be made of any suitable material.

The hoop member 4 may be arranged along an outer peripheral edge of the head 3 to hold the head 3 against the shell 2. The hoop member 4 may be made of any suitably rigid material, such as (but not limited to) metal, plastic, composite materials, synthetic resin, wood, and/or the like. The hoop member 4 may be operatively connected with the coupling device 20, which may be operatively connected with the fixing device 10, to stretch the head 3. As will be discussed later, the coupling device 20 may be adjusted to stretch the head 3 accordingly.

In some embodiments, the coupling device 20 may include an elongated body 21 (or any other suitably shaped body), such as (but not limited to) a pipe-shaped member or the like, and a rod member 22. The elongated body 21 may include an inner portion for receiving the rod member 22. The rod member 22 may be configured to pass through an aperture (e.g., hole 4*a* in FIG. 4) in the hoop member 4 into the inner portion of the elongated body 21. The rod member 22 may be secured (e.g., screwed) by turning a head 22*a* (e.g., FIG. 4) of the rod member 22 to bring the hoop member 4 toward the elongated body 21.

In further embodiments, the inner portion of the elongated body 21 may be threaded to receive a correspondingly threaded portion of the rod member 22. Thus, the rod member 22 may be inserted through the hoop member 4 into the inner portion of the elongated body 21 and screwed into place to bring the head 3 toward the elongated body 21. As such, the head 3 may be stretched with continued movement of the head 3 toward the elongated body 21 (e.g., further screwing of the rod member 22). The hoop member 4 and the head 3 may be removed by loosening the rod member 22 and removing the rod member 22 from the elongated body 21.

In some embodiments, a second end 2*c* (e.g., FIG. 4) of the shell 2 (the bottom of the drum 1 in FIG. 1) may be covered with a cover 5. The cover 5 may be made of a flexible material, such as a soft synthetic resin, an elastomer, rubber, and/or the like. In other embodiments, the cover 5 may be made of any suitable material.

The cover 5 may include a ring member 5*a* along an outer periphery of the cover 5. The ring member 5*a* (or other portion of the cover 5) may include a groove for receiving the second end 2*c* of the shell 2 to connect the cover 5 to the shell 2.

The ring member 5*a* may include a plurality of ears 5*b*, protrusions, or the like protruding (e.g., in a direction perpendicular to the axis of the shell) from an outer periphery of the ring member 5*a*. In particular embodiments, the ears 5*b* may be arranged to protrude from the ring member 5*a* at equal intervals. In other embodiments, the ears 5*b* may be arranged at any suitable locations along the ring member 5*a*.

With respect to an individual ear 5*b* of the plurality of ears 5*b*, the ear 5*b* may cover a coupling device 20 of the plurality of coupling devices 20. For instance, the ear 5*b* may include an aperture for receiving the elongated body 21 of the coupling device 20. In other embodiments, the elongated body 21 may include an aperture for receiving a portion of the ear 5*b*.

In some embodiments, a sheet 6 may be disposed on an outer peripheral surface 2*e* of the shell 2 to cover the outer peripheral surface 2*e* of the shell 2. The sheet 6 may come in a variety of colors, designs, and/or the like or be decorated by the user. Accordingly, the shell 2 can be decorated by the user by placing the sheet 6 (or replacing the sheet 6 with another sheet) on the outer peripheral surface 2*e* of the shell 2 and/or decorating the sheet 6 with various patterns, colors, and/or the like.

The shell 2 may be made of any suitable rigid material, such as a synthetic resin, plastic, metal, composite materials, wood, and/or the like. The shell 2 may include a mounting hole 30 for receiving attachment hardware (not shown) that allows the drum 1 to be attached to a support rod of a stand, or the like.

Figure 2:
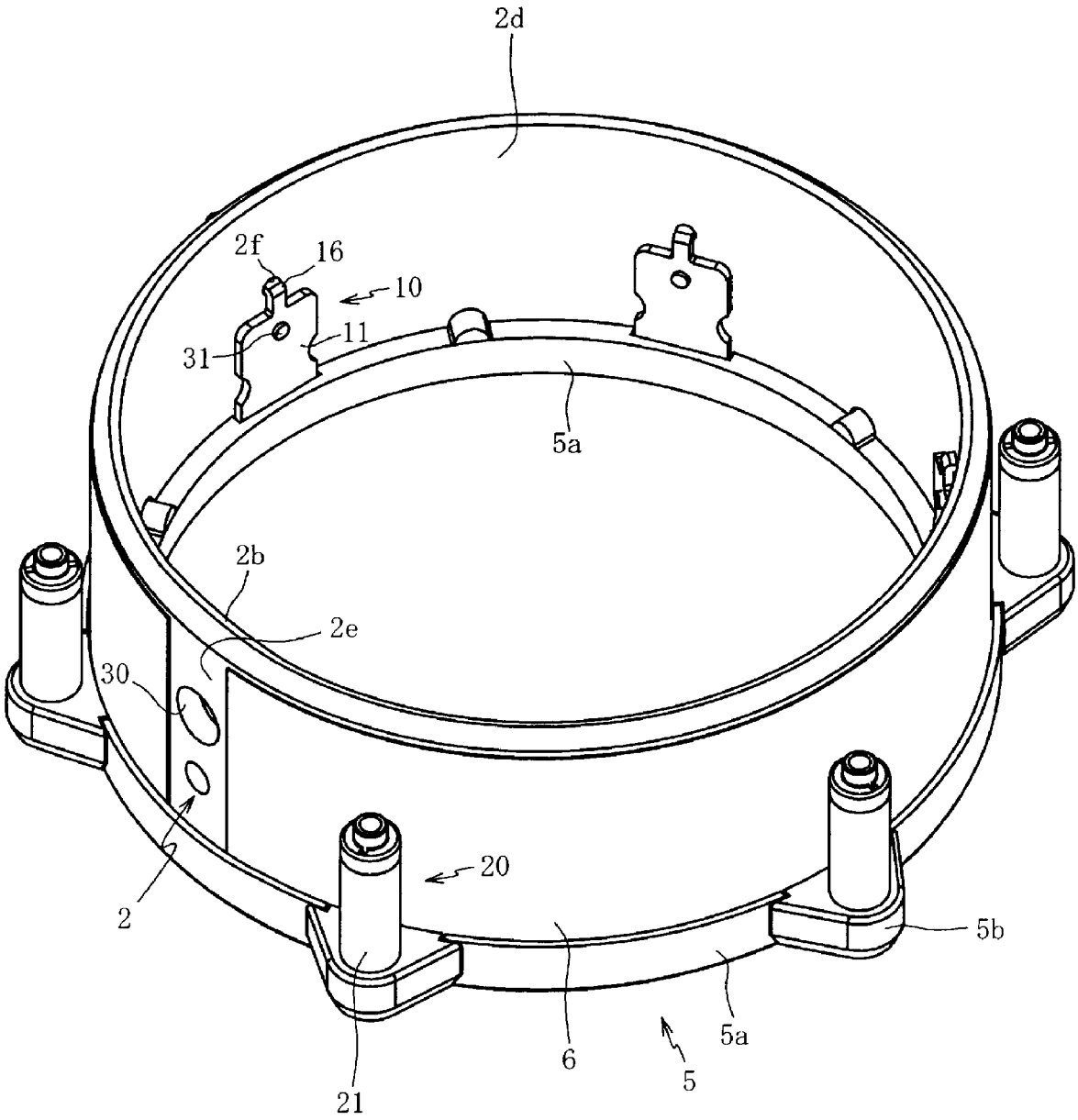
FIG. 2 is a perspective view of a percussion instrument according to an embodiment of the present invention.

FIG. 2 is a perspective view of a percussion instrument, such as the drum 1 (of FIG. 1), according to an embodiment of the present invention. In FIG. 2, drum 1 is shown with the hoop member 4 and the head 3 removed. With reference to FIGS. 1 and 2, the plurality of fixing devices 10 may be arranged along the second end 2*c* (the bottom of the drum 1 in FIG. 2) of the shell 2, for example along wall section 2*a* (e.g., FIG. 4) of the shell 2. In various embodiments, a bottom portion of the fixing devices 10 may be arranged on the second end 2*c* to be embedded or otherwise fit to the cover 5, for example, in the groove in which the second end 2*c* of the shell 2 is fit.

In various embodiments, the fixing device 10 may operatively connect the coupling device 20 with the shell 2. The fixing device 10 may be arranged opposite the coupling device 20 with the shell 2 in between. Thus, in embodiments, where each of the coupling devices 20 is spaced equally apart along the ring member 5*a*, each of the fixing devices 10 may be spaced equally apart. In other embodiments, where some or all of the coupling devices 20 are unequally spaced apart along the ring member 5*a*, some or all of the fixing devices 10 likewise may be unequally spaced apart.

FIGS. 3(*a*)-3(*c*) illustrate various views of a fixing device, such as the fixing device 10 (of FIG. 2), according to an embodiment of the present invention. With reference to FIGS. 1-3(*c*), the fixing device 10 may include a wall 11, a base 12, and an extension 13. The fixing device 10 may include a first hole 15 and a second hole 17.

The wall 11 may be arranged to be adjacent an inner peripheral surface 2*d* of the shell 2 in a case where the fixing device 10 is arranged along the shell 2. As shown in FIG. 3(*c*), the wall 11 may be formed to have a substantially rectangular shape when viewed from the front. In other embodiments, the wall 11 may be formed in any suitable shape, including (but not limited to) in a substantially square shape, substantially round shape, and/or the like.

As shown in FIG. 3(*a*), the base 12 may be formed to have a substantially rectangular shape when viewed from above. In other embodiments, the base 12 may be formed in any suitable shape, including (but not limited to) in a substantially square shape, substantially round shape, and/or the like. The base 12 may extend from the wall 11 in a substantially perpendicular direction, for example, to form roughly a right angle between the base 12 and the wall 11. The base 12 may extend from a bottom portion of the wall 11 so that the fixing device 10 forms an "L" shape when viewed from the side, as shown in FIG. 3(*b*). In other embodiments, the base 12 and the wall 11 may have an angle between each other that is less than that of a right angle. In yet other embodiments, the base 12 and the wall 11 may have an angle between each other that is more than that of a right angle.

Returning to FIGS. 1-3(*c*), the extension 13 may extend from the base 12 in a direction away from the wall 11. That is, the extension 13 may be a tip or end portion of the base 12. In some embodiments, the extension 13 may be tapered (in a direction away from the wall 11) so that a width dimension of the extension 13 decreases as the extension 13 extends away from the wall 11. In other embodiments, the extension 13 need not be tapered, and/or may be formed in any suitable shape.

In various embodiments, the wall 11, the base 12, and the extension 13 may be formed as a single unit, for example, by being a sheet of metal or the like that is bent to form the fixing device 10. In other embodiments, some or all of the wall 11, the base 12, and the extension 13 may be separate components that may be connected with each other. In further embodiments, the fixing device 10 may include one or more stiffening members, such ribs 14, and/or the like to increase rigidity of the fixing device 10. For instance, the ribs 14 may be provided between the wall 11 and the base 12. In such embodiments, the ribs 14 may substantially inhibit deformation of the wall 11 and the base 12.

The base 12 may be arranged to be adjacent the second end 2*c* of the shell 2 in a case where the fixing device 10 is arranged along the shell 2. In some embodiments, the base 12 may have a length that is roughly equal to a thickness of the wall section 2*a* (e.g., FIG. 4) of the shell 2. The extension 13 may be arranged to overhang or extend beyond the outer peripheral surface 2*e* of the shell 2 in a case where the fixing device 10 is arranged along the shell 2.

The extension 13 may include the first hole 15. The first hole 15 may be for receiving a portion (e.g., the insertion portion 23*a* in FIG. 4) of the elongated member 21, as will be discussed later. The first hole 15 may be roughly centered in the extension 13. In other embodiments, the first hole 15 may be located along any portion of the extension 13.

In some embodiments, the first hole 15 may be formed in a shape similar to a shape of the portion of the elongated member 21. In such embodiments, rotation of the portion of the elongated member 21 may be substantially inhibited. For example, the first hole 15 and the portion of elongated member 21 may be formed in a polygonal shape. In other embodiments, each of the first hole 15 and the portion of elongated member 21 may be formed in any suitable shape.

In some embodiments, the wall 11 may include a locking arm 16 and/or the like extending, for example, from an edge 11*a* of the wall 11 or from any other suitable portion of the wall 11. The locking arm 16 may be bent to protrude away from the wall 11 in a direction similar to the direction that the base 12 extends from the wall 11. The locking arm 16 of the fixing device 10 may be fit into a locking aperture 2*f* formed in the shell 2 in a case where the fixing device 10 is arranged along the shell 2. The locking arm 16 may secure the fixing device 10 to the shell 2. In some embodiments, the locking aperture 2*f* may be formed to allow some pivotal management of the locking arm 16 within the locking aperture 2*f*, which may reduce deformation of the fixing device 10 when a force acts upon the extension 13, as will be discussed.

In a case where the fixing device 10 is attached to the shell 2, the wall 11 of the fixing device 10 may be adjacent (e.g., in contact) with the inner peripheral surface 2*d* of the shell 2, and the base 12 of the fixing device 10 may be arranged on the second end 2*c* of the shell 2. As such, the extension 13 may overhang or extend beyond the outer peripheral surface 2*e* of the shell 2. The elongated body 21 of the coupling device 20 may be inserted at least partially into the ear 5*b* of the cover 5 and at least partially into the first hole 15 of the fixing device 10.

In some embodiments, the wall 11 may include the second hole 17, for example (but not limited to), in a vicinity of the edge 11*a*. As seen, for example, in FIG. 4, the shell 2 may include an insertion hole 2*g* aligned (e.g., concentrically aligned) with the second hole 17 of the fixing device 10 in a case where the fixing device 10 is arranged along the shell 2. As such, a fastening member 31, such as a screw, bolt, and/or the like, may be inserted into the insertion hole 2*g* of the shell 2 and the second hole 17 to attach the fixing device 10 to the inner peripheral surface 2*d* of the shell. In some embodiments, the insertion hole 2*g* and/or the second hole 17 may be formed to have a threaded inside to receive a correspondingly threaded portion of the fastening member 31.

Figure 4:
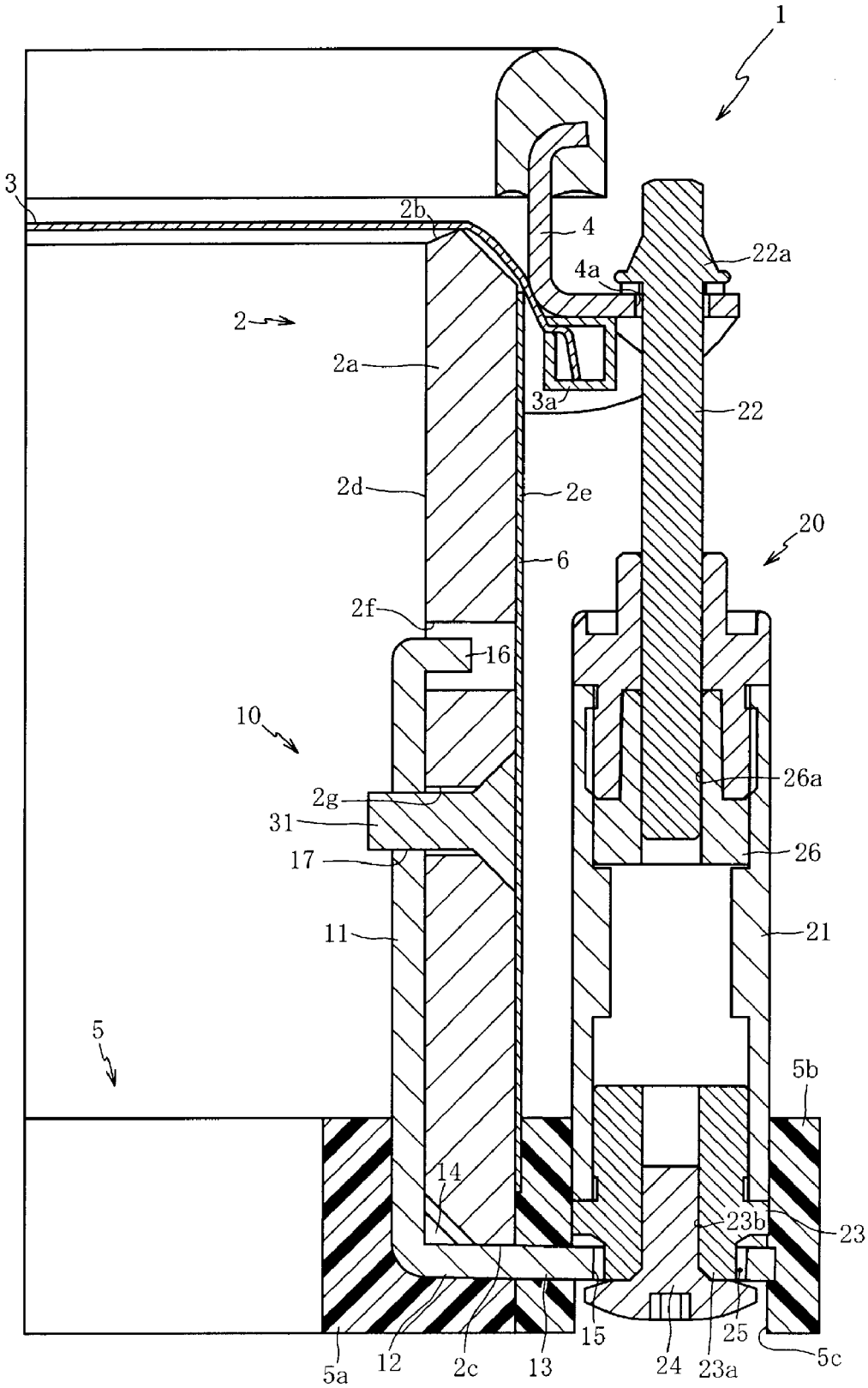
FIG. 4 is a cross-section view of a percussion instrument along the line IV-IV of FIG. 1 according to an embodiment of the present invention.

FIG. 4 is a cross-section view of a percussion instrument, such as the drum 1 (of FIG. 1), along the line IV-IV of FIG. 1 according to an embodiment of the present invention. The fixing device 10 may be arranged on the shell 2 such that the wall 11 is adjacent the inner peripheral surface 2*d* of the shell 2 and the base 12 of the fixing device 10 is arranged on the second end 2*c* of the shell 2. As can be seen in FIG. 4, the insertion hole 2*g* and the locking aperture 2*f* pass through the wall section 2*a* of the shell 2.

In various embodiments, a distance between the second end 2*c* of the shell 2 and the insertion hole 2*g* may be substantially equal to a distance between the base 12 of the fixing device 10 and the second hole 17 of the fixing device 10. A distance between the second end 2*c* of the shell 2 to the locking aperture 2*f* may be substantially equal to a distance between the base 12 of the fixing device 10 and the locking arm 16 of the fixing device 10. As such, in a case where the fixing device 10 is arranged on the shell 2, the insertion hole 2*g* of the shell 2 and the second hole 17 of the fixing device 10 may be aligned with each other to receive the fastening member 31, and the locking arm 16 of the fixing device 10 may be fit into the locking aperture 2*f* of the shell 2.

In some embodiments, the fixing device 10 may be configured such that a distance the locking arm 16 protrudes from the wall 11 of the fixing device 10 may be equal to or shorter than a thickness of the wall section 2*a* of the shell 2. As such, the locking arm 16 may be prevented from protruding out the locking aperture 2*f* through the outer peripheral surface 2*e* of the shell 2. Thus, in such embodiments, the sheet 6 may be placed on the outer peripheral surface 2*e* of the shell 2 evenly (i.e., free of any protrusions caused by the locking arm 16) to provide a more attractive appearance.

In various embodiments, the fastening member 31 may be a threaded member. After the fixing device 10 is arranged on the second end 2*c* of the shell 2, the fastening member 31 may be inserted into the insertion hole 2*g* from the outer peripheral surface 2*e* of the shell 2 and into the second hole 17 of the wall 11 of the fixing device 10. Accordingly, the wall 11 of the fixing device 10 can be affixed to the inner peripheral surface 2*d* of the shell 2. In other embodiments, the fastening member 31 may be inserted through the second hole 17 of the fixing device 10 from the inner peripheral surface 2*d* of the shell 2 into the insertion hole 2*g* to affix the fixing device 10 to the shell 2.

In some embodiments, such as (but not limited to) in a case where the shell 2 is made of wood or the like, a head portion of the fastening member 31 may be configured to embed in the outer peripheral surface 2*e* of the shell 2 by torque from screwing the fastening member 31 into the second hole 17 of the wall 11 of the fixing device 10. Accordingly, the head portion of the fastening member 31 may be prevented from protruding from the outer peripheral surface 2*e* of the shell 2 and/or from loosening from the shell 2. Thus, in such embodiments, the sheet 6 may be placed on the outer peripheral surface 2*e* of the shell 2 evenly (i.e., free of any protrusions caused by the fastening member 31) to provide a more attractive appearance.

In some embodiments, such as (but not limited to) in a case where the shell 2 is made of a hard synthetic resin, metal, and/or the like, the shell 2 may include a concavity, for example in alignment with the insertion hole 2*g*, on the outer peripheral surface 2*e* of the shell 2 having a size slightly larger than the head portion of the fastening member 31. Accordingly, the head portion of the fastening member 31 may be prevented from protruding from the outer peripheral surface 2*e* of the shell 2 and/or from loosening from the shell 2. Thus, in such embodiments, the sheet 6 may be placed on the outer peripheral surface 2*e* of the shell 2 evenly (i.e., free of any protrusions caused by the fastening member 31) to provide a more attractive appearance.

In various embodiments, the fixing device 10 may include the locking arm 16 formed on the wall 11, and the shell 2 may include the locking aperture 2*f* into which the locking arm 16 is fit. Thus, the fixing device 10 can be easily positioned along the inner peripheral surface 2*f* of the shell 2. By placing the locking arm 16 of the fixing device 10 into the locking aperture 2*f* of the shell 2 and arranging the base 12 of the fixing device 10 on the second end 2*c* of the shell 2, shifting or rotating of the fixing device 10 may be reduced while the fastening member 31 is inserted into the insertion hole 2*g* of the shell 2 and the second hole 17 of the fixing device 10 to attach the fixing device 10 to the shell 2. For instance, rotation of the fastening member 31 to secure the fastening member 31 into the second hole 17 of the fixing device 10 may cause the fastening member 31 to rotate the fixing device 10. However, in the above embodiments in which the fixing device 10 is attached to the shell 2 with the locking arm 16 in the locking aperture 2*f* and the base 12 arranged on the second end 2*c* of the shell 2, rotation of the fixing device 10 can be substantially reduced or prevented altogether.

The sheet 6 may be fixed or otherwise arranged on the outer peripheral shell 2*e* of the shell 2. For instance, a first edge of the sheet 6 may be arranged between the ring member 5*a* of the cover 5 and the outer peripheral surface 2*e* of the shell 2. A second edge, opposite the first edge, of the sheet 6 may be arranged between a frame 3*a* of the head 3 and the outer peripheral surface 2*e* of the shell 2.

In some embodiments, first and second ends of the sheet 6, which may be substantially perpendicular to the first edge and the second edge of the sheet 6, may be arranged, for example, on opposite sides of the mounting hole 30. The first and second ends of the sheet 6 may be held against the outer peripheral surface 2*e* of the shell 2 by attaching the attachment hardware (not shown) in the mounting hole 30. Such embodiments may prevent the sheet 6 from coming away from the shell 2 and may provide for a more attractive appearance. In other embodiments, the sheet 6 may be fixed or otherwise arranged on the outer peripheral surface 2*e* of the shell 2 in any suitable matter including with, but not limited to, a clamp member, fastening member (e.g., screw), and/or the like.

With the hoop member 4 and the head 3 removed from the shell 2, the first edge of the sheet 6 may be removed from the cover 5 and the shell 2. As such, the sheet 6 can be arranged and removed on the outer peripheral surface 2*e* of the shell 2 quickly and easily. In various embodiments in which the sheet 6 is secured without any fastening members or clamps, which may require apertures, slits, or the like in the sheet 6, the sheet 6 may be formed as a simple sheet or band (e.g., substantially rectangular). In other embodiments, the sheet 6 may be omitted altogether, for example, in a case where the user prefers the appearance of the shell 2 itself. The sheet 6 may be made of any suitably flexible material having sufficient rigidity, such as (but not limited to) metal, plastic, comparable material, paper, wood, and/or the like.

In a case where the fixing device 10 is attached to the shell 2, the groove of the ring member 5*a* may cover the second end 2*c* of the shell 2, a bottom portion of the wall 11 of the fixing device 10, and the base 12 of the fixing device 10. The extension 13 of the fixing device 10 may extend beyond the outer periphery of the ring member 5*a* into the ear 5*b* of the cover 5 and be operatively connected with the coupling device 20. For example, the ear 5*b* may include a hole 5*c* into which the elongated body 21 of the coupling device 20 is inserted. A fastening member, such as bolt 24, screw, and/or the like may be fit into the hole 5*c* to operatively connect the fixing device 10 with the coupling device 20.

In other embodiments, the cover 5 may be omitted. In such embodiments, in a case where the fixing device 10 is attached to the shell 2, for example, the wall 11 of the fixing device 10 may be affixed to the inner peripheral surface 2*d* of the shell 2, the base 12 of the fixing device 10 may be arranged on the second end 2*c* of the shell 2 with the extension 13 of the fixing device 10 extending beyond the outer peripheral surface 2*e* of the shell 2 and operatively connected with the coupling device 20.

The bolt 24, for example, may be fit into the hole 5*c* from a first side opposite a second side of the hole 5*c* into which the elongated body 21 is inserted. The hole 5*c* of the ear 5*b* may be aligned with the first hole 15 of the fixing device 10 in a case where the fixing device 10 is attached to the shell 2, thus allowing the bolt 24 to be inserted through the hole 5*c* of the ear 5*b* and the first hole 15 of the fixing device 10 to operatively connect the fixing device 10 with the coupling device 20.

In particular embodiments, a diameter of the hole 5*c* may be slightly larger than a diameter of the first hole 15 of the fixing device 10. Such embodiments may allow for easier insertion of the bolt 24 into the hole 5*c* and the first hole 15 of the fixing device 10. In other embodiments, the diameter of the hole 5*c* may be any size relative to the first hole 15 of the fixing device 10.

Thus in various embodiments, the coupling device 20 may be arranged over (or in) the hole 5*c*. For example, a first end of the elongated body 21 may be placed into the hole 5*c* of the ear 5*b* at least partially. In some embodiments, the first end of the elongated body 21 may include a nut-shaped member 23 (or other suitably shaped body). The nut-shaped member 23 may be provided in the hole 5*c*. The nut-shaped member 23 may include an insertion portion 23*a* extending away from the elongated body 21. The insertion portion 23*a* may be arranged in the first hole 15 of the fixing device 10 in a case where the fixing device 10 is attached to the shell 2. The insertion portion 23*a* may be for receiving the bolt 24, which may be inserted into the hole 5*c* of the ear 5*b* and the first hole 15 of the fixing device 10 and fastened to the insertion portion 23*a* of the nut-shaped member 23, to operatively connect the elongated body 21 of the coupling device 20 to the fixing device 10. In some embodiments, the nut-shaped member 23 may include threads 23*b* or the like for mating with corresponding threads of the bolt 24 or the like.

In some embodiments, the nut-shaped member 23 (or portion thereof) and/or the elongated body 21 may have a diameter greater than the diameter of the first hole 15 of the fixing device 10, which may prevent the elongated body 21 from falling out of the hole 5*c*. In some embodiments, the nut-shaped member 23 and/or the elongated body 21 may be configured to be supported in the hole 5*c*, for example, in a friction fitting, snap fitting, with an adhesive, fastening member, unitary construction of the two components, or the like. For instance, the diameter of the elongated body 21 and/or the nut-shaped member 23 may have a diameter substantially equal to the diameter of the hole 5*c* to provide a tight fitting to support the elongated body 21.

With respect to the head 3, the outer peripheral edge of the head 3 may be held in the frame 3*a* of the head 3, which may be fit to the first end 2*b* of the shell 2. The hoop member 4 may hold down the frame 3*a* against the first end 2*b* of the shell 2 from above. The hoop member 4 may be operatively connected to the fixing device 10 through the coupling device 20. For instance, the hoop 4 may include a hole 4*a* into which the rod member 22 may be inserted to fasten the rod member 22 to the elongated body 21. For example, the elongated body 21 may include a nut-shaped member 26 (or other suitably shaped body), opposite from the nut-shaped member 23 for receiving the rod member 22.

In some embodiments, the nut-shaped member 26 may include a threaded section 26*a* to which a threaded portion of the rod member 22 can mate. By fitting the rod member 22 into the nut-shaped member 26 of the elongated body 21, the hoop 4 may be operatively connected to the extension 13 of the fixing device 10. Further twisting (e.g., screwing) of the rod member 22 may bring the hoop number 4 toward the elongated body 21 to stretch the head 3 as desired.

In some embodiments, the nut-shaped member 26 and/or the nut-shaped member 23 may be integral with the elongated body 21. In other embodiments, one or both of the nut-shaped member 26 and the nut-shaped member 23 may be a separate component operatively connected with the elongated body 21.

Figure 5A:
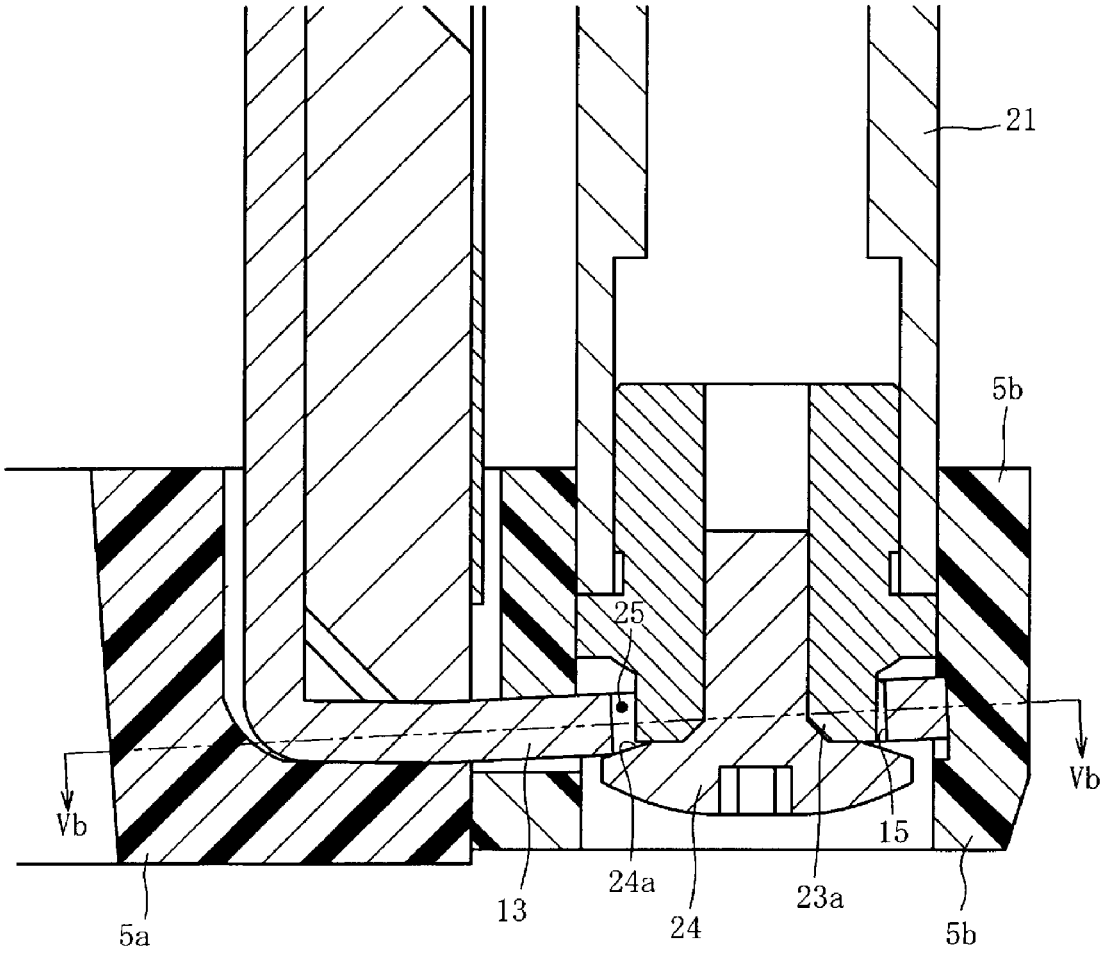
FIG. 5(*a*) is a partial expanded cross-section view of a portion of a fixing device and a portion of a coupling device according to an embodiment of the present invention.
Figure 5B:
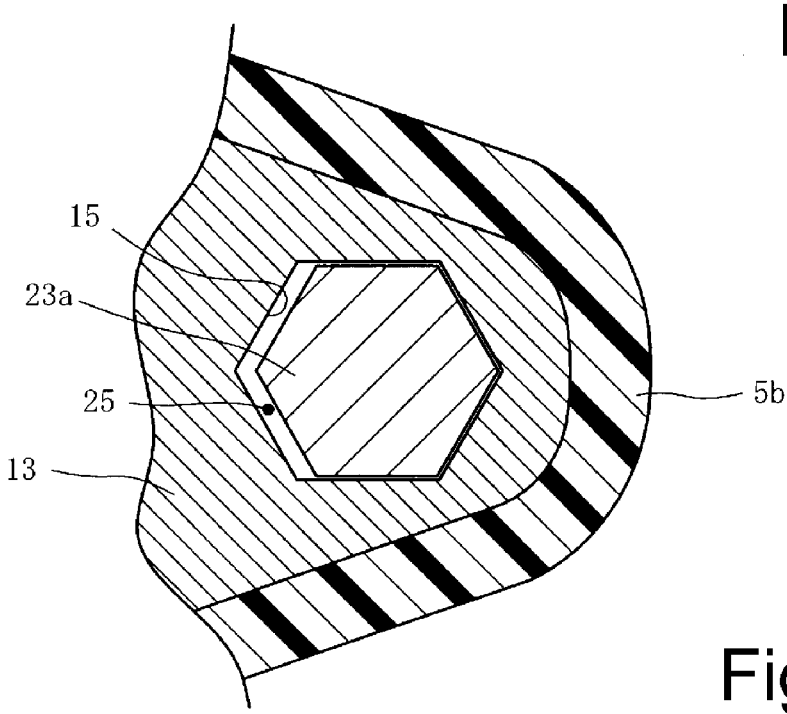

Next, an explanation will be provided relating to the extension 13 of the fixing device 10 in a case where the rod member 22 has been fastened (e.g., screwed) to the elongated body 21 (e.g., the nut-shaped member 26) while referring to FIGS. 5(*a*) and 5(*b*). FIG. 5(*a*) is a partial expanded cross-section view of a portion of a fixing device, such as the extension 13 of the fixing device 10 (e.g., FIG. 4), and a coupling device, such as the coupling device 20 (e.g., FIG. 4), according to an embodiment of the present invention. FIG. 5(*b*) is a partial cross-section view of a portion of a fixing device, such as the extension 13 of the fixing device 10 (e.g., FIG. 4), and a portion of a coupling device, such as the insertion portion 23*a* of the coupling device 20 (e.g., FIG. 4), along the line Vb-Vb of FIG. 5(*a*) according to an embodiment of the present invention.

With reference to FIGS. 1-5(*b*), a flexion of the extension 13 of the fixing device 10 may be produced when the rod member 22 is fastened to the elongated body 21 (e.g., the nut-shaped member 26). That is, as the rod member 22 is fastened (e.g., screwed) to the elongated body 21, for example, to stretch the head 4, a force may be applied on the extension 13 of the fixing device 10 that may cause the extension to flex or bend. A degree of the flexion may vary depending on the tensile force from fastening the rod member 22 and/or the structural strength of the extension 13 of the fixing device 10.

In some embodiments, a space 25 may be provided between the insertion portion 23*a* of the nut-shaped member 23 and an edge defining the first hole 15 of the fixing device 10. In particular embodiments, the space 25 may be provided between the extension 13 of the fixing device 10 and the insertion portion 23*a* in a direction perpendicular to the axis of the shell 2. In some embodiments, a portion of the coupling device 20 (e.g., the insertion portion 23*a* of the nut-shaped member 23) may be configured to be supported in the first hole 15 of the fixing device 10. For instance, the bolt member 24 may have a diameter that increases to a head portion 24*a* having a diameter larger than the diameter of the first hole 15 in the fixing device 10.

Because the diameter of the head portion 24*a* is larger than the diameter of the first hole 15 of the fixing device 10, the elongated body 21 can be supported within the first hole 15 of the fixing device 10 by inserting the bolt member 24 through the hole 5*c* of the ear 5*b* to fasten the bolt member 24 to the insertion portion 23*a* of the nut-shaped member 23 of the elongated body 21. The bolt member 24 may be fastened to the insertion portion 23*a* until the head portion 24*a* contacts a portion of the edge (e.g., left side in FIG. 5(*a*)) defining the first hole 15 of the fixing device 10. Thus, by fastening the bolt member 24 to the insertion portion 23*a*, the head portion 24*a* may prevent the portion of the coupling device 20 supported in the first hole 15 of the fixing device 10 from falling through (an opposite side from a side through which the portion of the coupling device 20 is inserted) the first hole 15 of the fixing device 10. Accordingly, the elongated body 21 may be supported on the extension 13 and extend away from the ear 5*b* of the ring member 5*a*.

In some embodiments, the head portion 24*a* of the bolt member 24 may have a convex spherical shape (e.g., substantially elliptical). In other embodiments, the head portion 24*a* may have any suitable shape. In various embodiments, the insertion member 23*a* and the first hole 15 of the fixing device 10 may be formed to have a polygonal shape, such as, but not limited to a hexagonal shape, pentagonal shape, and/or the like. In other embodiments, the insertion member 23*a* and the first hole 15 of the fixing device 10 may be formed in any suitable shape.

In a case where the rod member 22 is adjusted, for example, to stretch the head 3, the space 25 may allow the insertion portion 23*a* (and/or other portion of the elongated body 21) and the rod member 22 to retain a common axis while an angle of the extension 13 of the fixing device 10 relative to the insertion portion 23*a* (and/or other portion of the elongated body 21) changes from the force of the coupling device 20 acting upon it. That is, the insertion portion 23*a* may be allowed to move along the first hole 15 of the fixing device 10 as a force acts on the extension 13 of the fixing device 10 (e.g., from adjusting the rod member 22), which may bend the extension 13 relative to the wall 11 of the fixing device 10, while retaining a common axis with the rod member 22 as the rod member 22 is adjusted. Thus, in various embodiments, the wall 11 of the fixing device 10 may remain substantially parallel with the axis of the insertion portion 23*a* and the rod member 22, all of which may be substantially parallel with the axis of the shell 2, as the head 3 is stretched.

Such embodiments, for example, may reduce a force acting on the rod member 22 in a direction perpendicular to the axis of the rod member 22. Accordingly, excessive force may not be required to attach and detach the rod member 22, thus simplifying the attachment and removal process. In addition, such embodiments may reduce damage to threads on the rod member 22 and/or improve durability of the coupling device 20.

In various embodiments, the cover 5 may be for reducing vibration of the fixing device 10, which may generate unwanted noise, caused by striking the head 3. For instance, in embodiments that omit the cover 5, in a case where the head portion 24*a* of the bolt member 24 and the edge defining the first hole 15 are in contact, noise may be generated between the fixing device 10 and the coupling device 20 due to vibration of the shell 2 caused by striking the head 3. In embodiments that include the cover 5, the ring member 5*a* of the cover 5 may cover the second end 2*c* of the shell 2 and the base 12 of the fixing device 10, and the ear 5*b* may cover the extension 13 of the fixing device 10. Such embodiments may improve the suppression of vibration of the fixing device 10, thus preventing the generation of noise, for example by distributing some or all of the vibrations to the cover 5.

In various embodiments, each of the elongated body 21, the ring member 5*a*, the ear 5*b*, the fixing device 10 may be made of any suitably rigid material, such as (but not limited to) metal, plastic, composite materials, ceramic, glass, synthetic resin, wood, and/or the like.

Thus in various embodiments, a drum 1 may include a plurality of fixing devices 10 supported on a shell 2 of the drum 1. The fixing device 10 may include a wall 11, a base 12, and an extension 13. The wall 11 of the fixing device 10 may be affixable (or otherwise attachable) to an inner peripheral surface 2*d* of the shell 2. The base 12 of the fixing device 10, which may extend substantially perpendicularly from the wall 11 of the fixing device 10, may be arranged on a second end 2*c* of the shell 2. The extension 13 of the fixing device 10, which may extend from the base 12 of the fixing device 10, may extend beyond an outer peripheral surface 2*e* of the shell 2 and may be operatively connected to a coupling device 20 operatively connected to a hoop member 4 stretching a head 3 over a first end 2*b* of the shell 2. Accordingly, tensile force on the plurality of fixing devices 10, for example from stretching the head 3, supported on the shell 2 may be distributed. Thus, the plurality of fixing devices 10 can be affixed to the shell 2 without a rigid ring member or the like, which, for example, has a tendency to break or otherwise become deformed. Furthermore, omitting the ring member may reduce a weight of the drum 1.

In various embodiments, tensile force may be imparted to the head 3 without attached lugs, bolts, fasteners, or the like, for example, to the outer peripheral surface 2*e* of the shell 2. This is because the hoop member 4 is operatively connected to the inner peripheral surface 2*d* of the shell via the coupling device 20 and the fixing device 10. Accordingly, the hoop member 4 may be pulled toward the coupling device 20 along the direction of the axis of shell 2 to stretch the head 3. Furthermore, omitting these fastening members may reduce the weight of the drum 1.

In various embodiments, the wall 11 of the fixing device 10 may be adjacent (e.g., in contact with) the inner peripheral surface 2*d* of the shell 2. In such embodiments, the wall 11 of the fixing device 10 may not be seen on the outer peripheral surface 2*e* of the shell 2, thus providing a more attractive appearance of the shell 2.

In addition, the wall 11 and the base 12 of the fixing device 10 may be arranged on the inner peripheral surface 2*d* and the second end 2*c* of the shell 2, respectively with the extension 13 of the fixing device 10 extending beyond the outer peripheral surface 2*e* of the shell 2. As such, bending of the extension 13 (or any other portion of the fixing device 10) is much more difficult. Accordingly, the fixing device 10 can be operatively connected to the coupling device 20, which may be for stretching the head 3, in a satisfactory manner. Such embodiments may allow for reducing a weight of the fixing device 10, and thus the weight of the drum 1 as well.

In various embodiments, the fixing device 10 may be formed to have a length from the base 12 of the fixing device 10 to the insertion hole 2*g* of the shell 2 (in a case where the fixing device 10 is arranged on the shell 2) greater than a length from the base 12 of the fixing device 10 to the extension 13 of the fixing device 10. As such, the fixing device 10 may function as a lever with the base 12 of the fixing device 10 as a fulcrum, the extension 13 of the fixing device 10 as a leverage point, and the insertion hole 2*g* of the shell 2 as a point of action. Thus, the fixing device 10 can be affixed to the shell 2 with a light force from the fastening member 31 despite a heavier force being imparted on the extension 13 of the fixing device 10 by the coupling device 20. Such embodiments may allow for reducing the weight of the fixing device 10, and thus the weight of the drum 1 as well.

Figure 6:
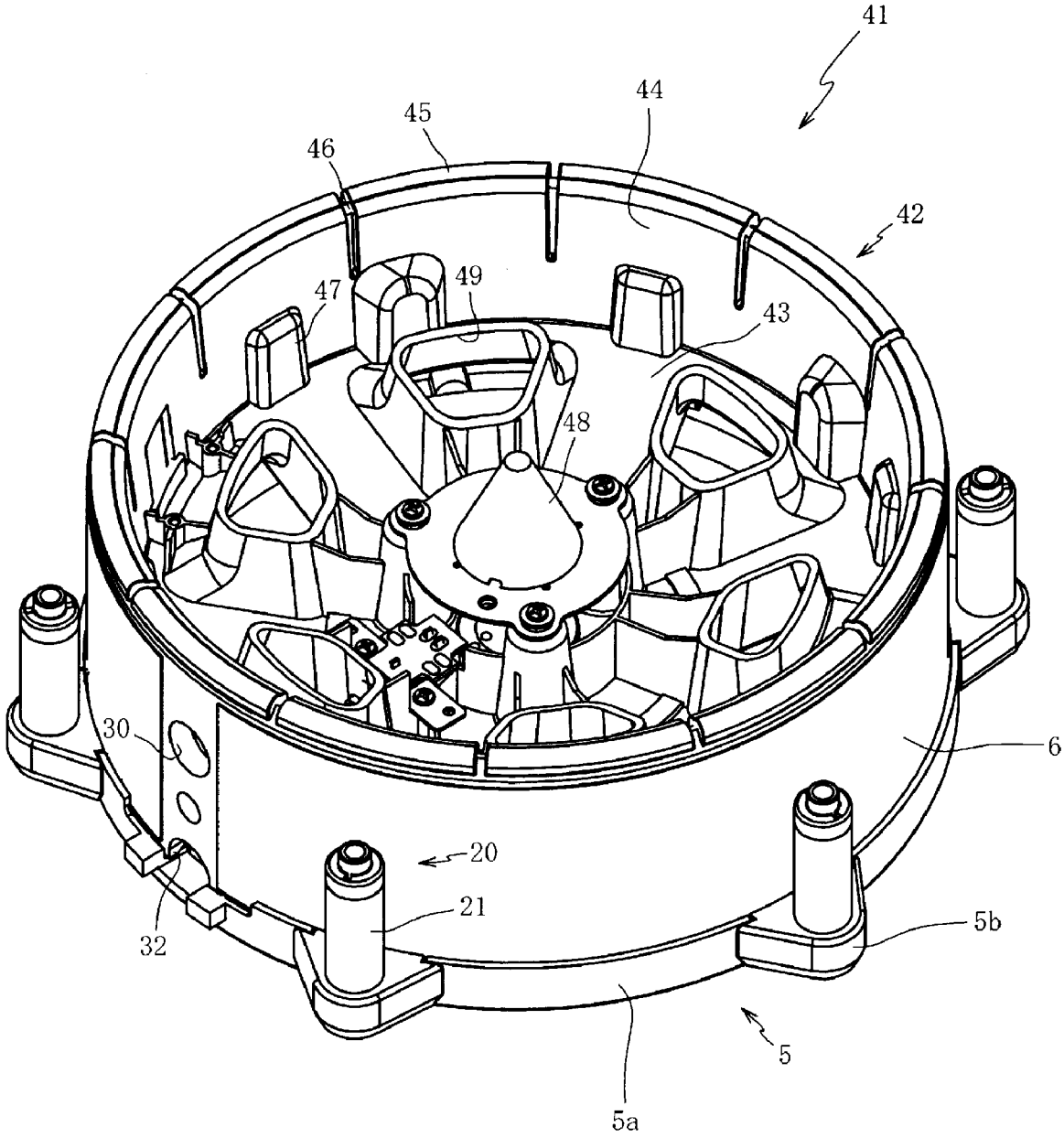
FIG. 6 is a perspective view of a percussion instrument according to an embodiment of the present invention.

In addition, some or all of the features shown in FIGS. 6-7(*b*) may be combined in various ways and included in the embodiments shown in FIGS. 1-5(*b*). Likewise, it should be understood that any of the features of the embodiments of FIGS. 1-5(*b*) may be combined or otherwise incorporated into any other embodiment(s) of FIGS. 1-5(*b*) as well as any other embodiment herein discussed.

FIG. 6 is an perspective view of a percussion instrument according to an embodiment of the present invention. Reference numbers of FIG. 6 and related explanations that are the same as those discussed in the disclosure have been omitted. In addition, some or all of the features shown in FIGS. 1-5(*b*), 7(*a*), and 7(*b*) may be combined in various ways and included in the embodiments shown in FIG. 6. Likewise, it should be understood that any of the features of the embodiments of FIG. 6 may be combined or otherwise incorporated into any other embodiment(s) of FIG. 6 as well as any other embodiment herein discussed.

In various embodiments, the percussion instrument may be a drum 41, and/or the like. The drum 41 may be an electronic drum, for example, employing a sensor (e.g., vibration sensitive element) configured to detect vibrations of the head 3 caused by striking the head 3. The drum 41 may include the shell 2, the head 3, the hoop member 4, and a frame 42. In FIG. 6, the drum 41 is shown with the hoop member 4 and the head 3 (e.g., FIG. 1) removed.

With reference to FIGS. 1-6, the frame 42 may be arranged inside the shell 2. The frame 42 may comprise a floor 43 and a cylindrical wall 44. The floor 43 may have a disk shape (or other shape similar to that formed by the shell 2) having a diameter that is slightly smaller than a diameter inside the shell 2. The cylindrical wall 44 may extend from a peripheral edge of the floor 43 toward the first end 2*b* of the shell 2. The cylindrical wall 44 may have a height slightly less than a height of the shell 2.

The frame 42 may be made of any suitable rigid material, such as a synthetic resin, plastic, metal, glass, composite materials, and/or the like. The floor 43 and the cylindrical wall 44 may be formed as a single unit. In other embodiments, the floor 43 and the cylindrical wall may be separate components connected together.

In some embodiments, the cylindrical wall 44 may include a brim 45 around at least a portion of a periphery of the cylindrical wall 44 for attaching over the first end 2*b* of the shell 2. In various embodiments, the frame 42 may be provided with a plurality of slits 46, notches, or the like extending from the brim 45 to a portion of the cylindrical wall 44. In some embodiments, the slits 46 may extend from the brim 45 to the floor 43. The slits 46 may provide a better fit between the frame 42 and the shell 2. For instance, by placing the frame 42 within the shell 2, the slits 46 may narrow to allow the frame 42 to be placed within the shell 2. Furthermore, such embodiments may substantially prevent the frame 42 from rotating within the shell 2.

In some embodiments, concavities 47 may be formed along specified locations along the frame 42, for example, corresponding to locations where fixing devices 10 are attached to the shell 2. In such embodiments, the frame 42 may be arranged deep into the shell 2 without being obstructed by the fixing devices 10.

A sensor, such as a striking sensor 48 for sensing a vibration, may be arranged on the floor 43. In particular embodiments, the striking sensor 48 may be centered on the floor 43. The striking sensor 48 may have a height selected such that a tip of the striking sensor 48 is adjacent (e.g., contacts) the head 3 stretched across the shell 2. Accordingly, the striking sensor 48 can detect vibrations on the head 3, for example, caused by striking the head 3 to produce a signal. The signal can be transmitted by the striking sensor 48 via associated wiring (not shown) that passes through a wiring hole 32 formed in the shell 2 (and/or the frame 42).

In further embodiments, air vents 49 may be provided at specified locations around the striking sensor 48, for example, on the floor 43 and/or the cylindrical wall 44 of the frame 42. Thus, air in the frame 42 that vibrates from striking the head 3 may escape through the air vents 49 and out the frame 42 and/or the shell 2. Consequently, a volume of a sound produced from striking the head 3 may be reduced. Thus, interference of the sound produced from striking the head 3 with a performance as detected by the striking sensor 48 can be substantially prevented.

The outer peripheral edge of the head 3 may be held in the frame 3*a*, which may be fit to the brim 45 of the frame 42 and the first end 2*b* of the shell 2. The hoop member 4 may hold down the frame 3*a* against the brim 45 of the frame and the first end 2*b* of the shell 2 from above. The rod member 22 may be inserted into the hole 4*a* of the hoop and secured to the elongated body 21, thus allowing the frame 3*a* to be pulled toward the elongated body 21 to stretch the head 3, for example, as discussed in the disclosure.

In various embodiments, a drum 41 may include a plurality of fixing devices 10 supported on a shell 2 of the drum 41. The fixing device 10 may include wall 11, base 12, and an extension 13. The wall 11 of the fixing device 10 may be affixable to an inner peripheral surface 2*d* of the shell 2. The base 12 of the fixing device 10, which may extend substantially perpendicularly from the wall 11, may be arranged on a second end 2*c* of the shell 2. The extension 13 of the fixing device 10, which may extend from the base 12, may extend beyond an outer peripheral surface 2*e* of the shell 2 and may be operatively connected to a coupling device 20 operatively connected to a hoop member 4 stretching a head 3 over a first end 2*b* of the shell 2. Accordingly, tensile force on the plurality of fixing devices 10, for example from stretching the head 3, supported on the shell 2 may be distributed. Thus, the plurality of fixing devices 10 can be affixed to the shell 2 without a rigid ring member or the like, which, for example, has a tendency to break or otherwise become deformed. Furthermore, omitting the ring member may reduce a weight of the drum 41.

FIG. 7(*a*) is a cross-section view of a percussion instrument, such as drum 51, according to an embodiment of the present invention. Reference numbers of FIG. 7(*a*) and related explanations that are the same as those discussed in the disclosure have been omitted. In addition, some or all of the features shown in FIGS. 1-6 and 7(*b*) may be combined in various ways and included in the embodiments shown in FIG. 7(*a*). Likewise, it should be understood that any of the features of the embodiments of FIG. 7(*a*) may be combined or otherwise incorporated into any other embodiment(s) of FIG. 7(*a*) as well as any other embodiment herein discussed.

The drum 51 may include the shell (or body) 2, the head (or membrane) 3, the hoop member 4, a plurality of fixing devices 60, and a plurality of coupling devices 70. Reference may be made to an individual fixing device 60, and/or an individual coupling device 70 as applying to all other fixing devices of the plurality of fixing devices 60 and/or all other coupling devices of the plurality of coupling devices 70, respectively, unless otherwise noted.

The fixing device 60 may include a first wall 61, a base 62, and an extension 63. The fixing device 60 may include a first hole 65 and a second hole 67. In various embodiments, the first wall 61, the base 62, and the second hole 67 may be substantially similar to the wall 11 of the fixing device 10, the base 12 of the fixing device 10, and the second hold 17 of the fixing device 10, respectively, for example, as described with respect to FIGS. 1-5(*b*).

With reference to FIG. 7(*a*) of the fixing device 60, the first wall 61 of the fixing device 60 may be arranged to be adjacent (e.g., in contact with) the inner peripheral surface 2*d* of the shell 2 in a case where the fixing device 60 is arranged along the shell 2. The first wall 61 of the fixing device 60 may include the second hole 67, which may be aligned with the insertion hole 2*g* of the shell 2 in a case where the fixing device 60 is arranged on the shell 2 for receiving the fastening member 31. The base 62 of the fixing device 60 may extend from the first wall 61 of the fixing device 60 in a substantially perpendicular direction, for example, to form roughly a right angle (or other suitable angle) between the first wall 61 and the base 62 of the fixing device 60.

The extension 63 of the fixing device 60 may extend from the base 62 of the fixing device 60 in a direction away from the first wall 61 of the fixing device 60. That is, the extension 63 of the fixing device 60 may be a tip or end portion of the base 62 of the fixing device 60. The extension 63 of the fixing device 60 may include a second wall 63*a* extending from the extension 63 in a substantially perpendicular direction, for example, to form roughly a right angle (or other suitable angle) between the extension 63 and the second wall 63*a* of the fixing device 60. Thus, the fixing device 60 may form a "C" (or "U") shape when viewed from the side, as shown in FIG. 7(*a*). In other words, the second wall 63*a* of the fixing device 60 may be substantially parallel with the first wall 61 of the fixing device 60 and/or the shell 2.

The base 62 of the fixing device 60 may be arranged to be adjacent the second end 2*c* of the shell 2 in a case where the fixing device 60 is arranged along the shell 2. In some embodiments, the base 62 of the fixing device 60 may have a length that is roughly equal to a thickness of the wall section 2*a* of the shell 2. The extension 63 of the fixing device 60 may be arranged to overhang or extend beyond the outer peripheral surface 2*e* of the shell 2 in a case where the fixing device 60 is arranged on the shell 2.

In various embodiments, the first wall 61, the base 62, the extension 63, and the second wall 63*a* of the fixing device 60 may be formed as a single unit, for example, by being a sheet of metal or the like that is bent to form the fixing device 60. In other embodiments, some or all of the first wall 61, the base 62, the extension 63, and the second wall 63*a* of the fixing device 60 may be separate components that may be connected with each other.

In some embodiments, the fixing device 60 may include one or more stiffening members, such as ribs 64, and/or the like to increase rigidity of the fixing device 60. For instance, the ribs 64 may be provided between the first wall 61 and the base 62 of the fixing device 60 and/or between the extension 63 and the second wall 63*a* of the fixing device 60. In such embodiments, the ribs 64 may substantially inhibit deformation of the first wall 61 and the base 62 of the fixing device 60 and/or the extension 63 and the second wall 63*a* of the fixing device 60.

The coupling device 70 may include a receptacle 71 and a rod member 72, which may be similar to the rod member 22 (e.g., FIGS. 1-5(*b*)). The receptacle 71 may be formed, for example, in a box shape (e.g., a parallelepiped). In other embodiments, the receptacle 71 may be formed in any suitable shape or configuration. The receptacle 71 may include a hole 71*a* on a surface (e.g., on the top surface in FIG. 7(*a*)) into which the rod member 72 is passed. In some embodiments, at least one surface of the receptacle 71 may be open (e.g., the right surface in FIG. 7(*a*)). In other embodiments, an open surface may be omitted.

The second wall 63*a* of the fixing device 60 may include one or more of the first hole 65. In the embodiment shown in FIG. 7(*a*), the second wall 63*a* of the fixing device 60 includes two first holes 65. In other embodiments, the second wall 63*a* of the fixing device 60 may include any suitable number of first holes 65, including fewer first holes 65 or additional first holes. In embodiments having two or more first holes 65, some or all of the first holes 65 may be aligned (e.g., vertically or horizontally) with respect to each other. In other embodiments, the first holes 65 need not be aligned.

In various embodiments, the fixing device 60 may be operatively connected to the coupling device 70. For instance, the receptacle 71 may include one or more insertion members 74 protruding from a surface of the receptacle 71 such that the insertion members 74 may be fit within the one or more first holes 65 in the second wall 63*a* of the fixing device 60. For example, the insertion members 74 may be formed to have an "L" shape (e.g., when viewed from the side in FIG. 7(*a*)) protruding from a side 71*b* of the receptacle 71. In such embodiments, the insertion members 74 may be inserted into the first holes 65 in the second wall 63 to couple the receptacle 71 to the fixing device 60.

A nut-shaped member 73 (or the like), which may be like nut-shaped member 26 (e.g., FIGS. 1-5(*b*)), may be arranged in the hole 71*a* of the receptacle 71 and fastened to the rod member 72 to operatively engage the rod member 72 with the receptacle 71. In particular embodiments, the nut-shaped member 73 may be supported in the hole 71*a* of the receptacle 71 such that rotation of the nut-shaped member 73 is limited. For instance, the nut-shaped member 73 and the hole 71*a* may be formed to have a similar shape, for example as discussed with respect to the insertion portion 23*a* and the first hole 15 of the fixing device 10 (e.g., FIGS. 1-5(*b*)). In particular embodiments the nut-shaped member 73 may be supported in the hole 71*a* of the receptacle 71 to prevent the nut-shaped-member 73 from passing through the hole 71*a*, for example, in a friction fitting, snap fitting, with an adhesive fastening member, unitary construction of the two components, or the like.

In some embodiments, a space, such as the space 25 (e.g., FIGS. 4-5(*b*)), may be provided between the nut-shaped member 73 and an edge defining the hole 71*a*. In particular embodiments, the space may be provided between the receptacle 71 and the nut-shaped member 73 in a direction perpendicular to the axis of the shell 2. Thus, in a case where the rod member 72 is adjusted, for example, to stretch the head 3, the space may allow the nut-shaped member 73 and the rod member 72 to retain a common axis while an angle of the second wall 63*a* of the fixing device 60 relative to the axis of the nut-shaped member 73 and the rod member 72 changes from the force of the coupling device 70 acting upon it. That is, the nut-shaped member 73 may be allowed to move along the hole 71*a* of the receptacle 71 as a force acts on the second wall 63*a* (e.g., from adjusting the rod member 72) of the fixing device 60, which may bend the second wall 63*a* relative to the extension 63 and/or the base 62 of the fixing device 60 (i.e., the second wall 63*a* may no longer be substantially parallel with the first wall 61) while retaining a common axis with the rod member 72 as the rod member 72 is adjusted. Thus in various embodiments, the first wall 61 of the fixing device 60 may remain substantially parallel with the axis of the nut-shaped member 73 and/or the rod member 72, all of which may be substantially parallel with the axis of the shell 2, as the head 3 is stretched.

Such embodiments, for example, may reduce a force acting on the rod member 72 in a direction perpendicular to the axis of the rod member 72. Accordingly, excessive force may not be required to attach and detach the rod member 72, thus simplifying the attachment and removal process. In addition, such embodiments may reduce damage to threads on the rod member 72 and/or improve durability of the coupling device 70.

The rod member 72 may be inserted through the hole 4*a* of the hoop member 4 into the hole 71*a* of the receptacle 71 and fastened to the nut-shaped member 73. In some embodiments, the rod member 72 may include threads or the like for mating with corresponding threads on an inner portion of the nut-shaped member 73. The rod member 72 may be secured (e.g. screwed in) by turning a head 72*a* of the rod member 72 to bring the hoop member 4 toward the receptacle 71.

Thus, in various embodiments, a drum 51 may include a plurality of fixing devices 60 supported on a shell 2 of the drum 51. The fixing device 60 may include a first wall 61, a base 62, an extension 63, and a second wall 63*a*. The first wall 61 of the fixing device 60 may be affixable to an inner peripheral surface 2*d* of the shell 2. The base 62 of the fixing device 60, which may extend substantially perpendicularly from the first wall 61, may be arranged on second end 2c of the shell 2. The extension 63 of the fixing device 60, which may extend from the base 62, may extend beyond the outer peripheral surface 2e of the shell 2. The second wall 63a of the fixing device 60, which may extend substantially perpendicularly from the extension 63, may be operatively, connected to a coupling device 70 that is operatively connected to a hoop member 4 stretching a head 3 over a first end 2b of the shell 2. Accordingly, tensile force on the plurality of fixing devices 60, for example from stretching the head 3, may be distributed. Thus, the plurality of fixing devices 60 can be affixed to the shell 2 without a rigid ring member or the like, which, for example, has a tendency to break or otherwise become deformed. Furthermore, omitting the ring member may reduce a weight of the drum 51.

Figure 7B:
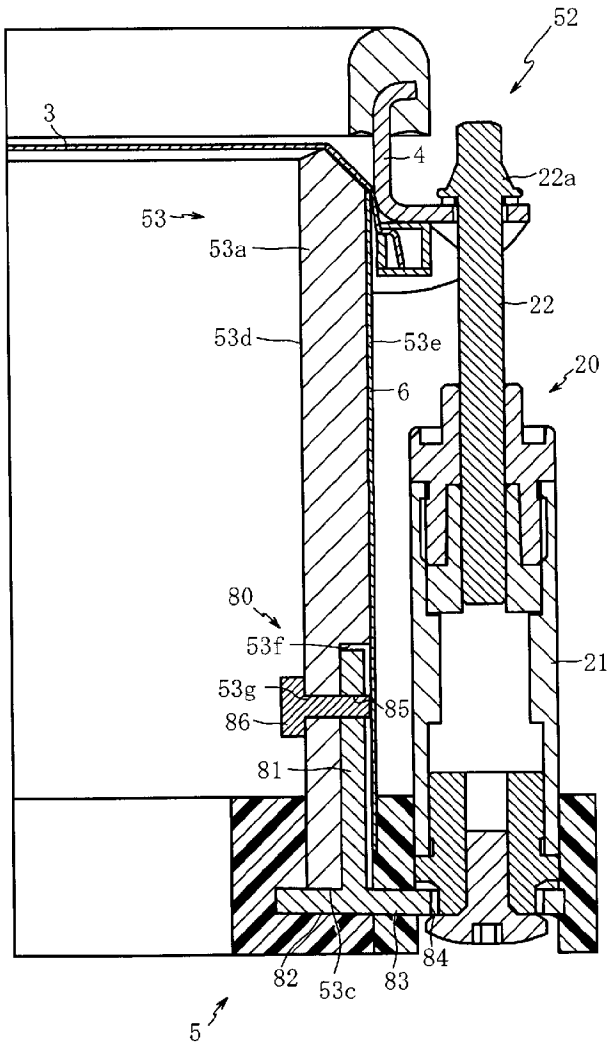
FIG. 7(*a*) is a cross-section view of a percussion instrument according to an embodiment of the present invention.
Figure 7A:
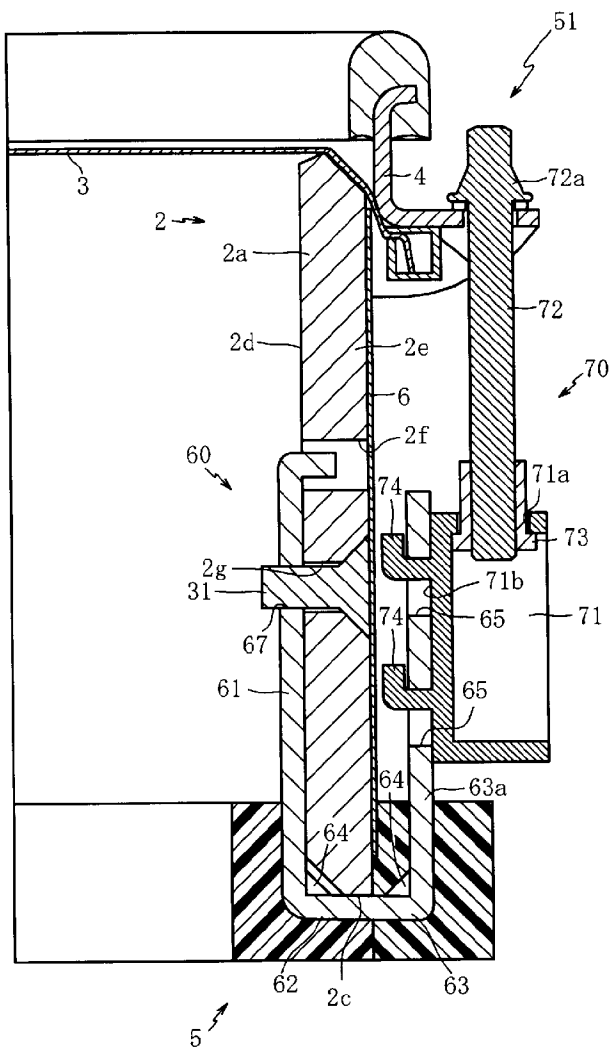

FIG. 7(b) is a cross-section view of a percussion instrument, such as drum 52, according to an embodiment of the present invention. Reference numbers of FIG. 7(b) and related explanations that are the same as those discussed in the disclosure have been omitted. In addition, some or all of the features shown in FIGS. 1-7(a) may be combined in various ways and included in the embodiments shown in FIG. 7(b). Likewise, it should be understood that any of the features of the embodiments of FIG. 7(b) may be combined or otherwise incorporated into any other embodiment(s) of FIG. 7(b) as well as any other embodiment herein discussed.

The drum 52 may include a shell (or body) 53, the head (or membrane) 3, the hoop member 4, a plurality of fixing devices 80, and the plurality of coupling devices 20. Reference may be made to an individual fixing device 80 and/or an individual coupling device 20 as applying to all other fixing devices of the plurality at fixing devices 80 and/or all other coupling devices of the plurality of coupling devices 20, respectively, unless otherwise noted.

The fixing device 80 may include a wall 81, a base 82, and an extension 83. The fixing device 80 may include a first hole 84 and a second hole 85. The wall 81 of the fixing device 80 may be arranged to be adjacent an outer peripheral surface 53e of the shell 53 in a case where the fixing device 80 is attached to (or otherwise arranged on) the shell 53. The base 82 of the fixing device 80 may extend from the wall 81 of the fixing device 80 in a substantially perpendicular direction in a direction toward an inner peripheral surface 53d of the shell 53, for example, to form roughly a right angle (or other suitable angle) between the wall 81 and the base 82. The base 82 of the fixing device 80 may be arranged to be adjacent or otherwise arranged on the second end 53c of the shell 53 in a case where the fixing device 80 is attached to (or otherwise arranged on) the shell 53. In some embodiments, the base 82 of the fixing device 80 may extend beyond the inner peripheral surface 53d of the shell 53.

The extension 83 of the fixing device 80 may extend from the wall 81 in a substantially perpendicular direction in a direction opposite the base 82, for example, to form roughly a right angle (or other suitable angle) between the wall 81 and the extension 83, so that the fixing device 80 may form an upside-down "T" shape when viewed from the side, as shown in FIG. 7(b). The extension 83 of the fixing device 80 may be arranged to overhang or extend beyond the outer peripheral surface 53e of the shell 53 in a case where the fixing device 80 is attached to (or otherwise arranged on) the shell 53.

In various embodiments, the wall 81, the base 82, and the extension 83 of the fixing device 80 may be formed as a single unit, for example, by being a sheet of metal or the like that is bent to form the fixing device 80. In other embodiments, some or all of the wall 81, the base 82, and the extension 83 of the fixing device 80 may be separate components that may be connected with each other.

In some embodiments, the shell 53 may include a recess 53f in the outer peripheral surface 53e of the shell 53, for example, near the second end 53c (e.g., bottom of FIG. 7(b)) of the shell 53. A depth of the recess 53f may be slightly greater than a thickness of the wall 81 of the fixing device 80. Accordingly, the wall 81 of the fixing device 80 may be fit in the recess 53f. Thus, any protrusions on the outer peripheral surface 53e of the shell 53 can be mitigated. As such, the sheet 6 may be placed on the outer peripheral surface 53e of the shell 53 evenly (i.e., free of any protrusions caused by the fixing device 80) to provide a more attractive appearance. In other embodiments, the recess 53f may be omitted and the wall 81 of the fixing device 80 may be attached directly to the outer peripheral surface 53e of the shell 53. In yet other embodiments, the recess 53f may be located at any suitable location along the shell 53 including, but not limited to, the inner peripheral surface 53d of the shell 53.

The shell 53 may include an insertion hole 53g that passes from the inner peripheral surface 53d of the shell 53 and opens to the recess 53f (or otherwise to the outer peripheral surface 53e of the shell 53). The second hole 85 may be provided on the wall 81 of the fixing device 80 at a position corresponding to the insertion hole 53g of the shell 53 in a case where the fixing device 80 is attached to (or otherwise arranged on) the shell 53. A fastening member 86 may be inserted into the insertion hole 53g from the inner peripheral surface 53d of the shell 53 and into the second hole 85 of the fixing device 80. Accordingly, the wall 81 of the fixing device 80 can be affixed to the shell 53. In some embodiments, the second hole 85 of the fixing device 80 may be formed to have threads or the like to receive a correspondingly threaded fastening member 86 or the like. In other embodiments, the fastening member 86 may be inserted into the second hole 85 of the fixing device 80 from the outer peripheral surface 53e of the shell 53 and into the insertion hole 53g of the shell 53.

In further embodiments, the wall 81 of the fixing device 80 may include a locking arm (e.g., 16 in FIGS. 3(a)-4) and/or the like extending, for example, from the wall 81 of the fixing device 80. In a case where the fixing device 80 is attached to (or otherwise arranged on) the shell 53, the wall 81 of the fixing device 80 may be adjacent (e.g., in contact) with, for example, the outer peripheral surface 53e of the shell 53. Accordingly, the locking arm may be insertable into a locking aperture (e.g., 2f in FIGS. 2 and 4) or the like provided in the shell 53, for example, as previously described.

The extension 83 of the fixing device 80 may include the first hole 84 for receiving a portion (e.g., the insertion portion 23a) of the elongated member 21, for example, as discussed with respect to FIGS. 1-5(b). With reference to FIGS. 1-7(b), the first hole 84 may be roughly centered in the extension 83 of the fixing device 80. In other embodiments, the first hole 84 may be located along any portion of the extension 83 of the fixing device 80. In some embodiments, the first hole 84 may be formed in a shape similar to a shape of the portion of the elongated member 21. In such embodiments, rotation of the portion of the elongated member 21 may be substantially inhibited. For example, the first hole 84 and the portion of elongated member 21 may be formed in a polygonal shape. In other embodiments, each of the first hole 84 and the portion of elongated member 21 may be formed in any suitable shape.

Thus, in various embodiments, a drum 52 may include a plurality of fixing devices 80 supported on a shell 53 of the drum 52. The fixing device 80 may include a wall 81, a base 82, and an extension 83. The wall 81 of the fixing device 80 may be affixable to an outer peripheral surface 53*e* of the shell 53, for example, within a recess 53*f*. The base 82 of the fixing device 80, which may extend substantially perpendicularly in a first direction from the wall 81 of the fixing device 80 (e.g., in a direction of an inner peripheral surface 53*d* of the shell 53), may be arranged on a second end 53*c* of shell 53. The extension 83 of the fixing device 80, which may extend substantially perpendicularly in a second direction from the wall 81 of the fixing device 80 opposite the first direction of the base 82 of the fixing device 80, may extend beyond the outer peripheral surface 53*e* of the shell 53 and may be operatively connected to a coupling device 20 that is operatively connected to a hoop member 4 stretching a head 3 over a first end 53*b* of the shell 53. Accordingly, tensile force on the plurality of fixing devices 80, for example from stretching the head 3, may be distributed. Thus, the plurality of fixing devices 80 can be affixed to the shell 53 without a rigid ring member or the like, which, for example, has a tendency to break or otherwise become deformed. Furthermore, omitting the ring member may reduce a weight of the drum 52.

In some embodiments, the base 82 of the fixing device 80 may be configured to fit to the shell 53. For example, a tip of the base 82 of the fixing device 80 may bend upward along the inner peripheral surface 53*d* of the shell 53 to fit to the second end 53*c* of the shell 53. In such embodiments, bending by the wall 81 of the fixing device 80 caused by, for example, operating (e.g., screwing) the coupling device 20 may be reduced.

In some embodiments, an angle between the wall 81 of the fixing device 80 and the extension 83 of the fixing device 80 may be greater than 90 degrees. Such embodiments may account for any bending of the extension 83 caused by operating the coupling device 20 (e.g., screwing one of the rod member 22 of the fixing device 80 and the bolt member 24). In other embodiments, the angle between the wall 81 of the fixing device 80 and the extension 83 of the fixing device 80 may be any suitable angle.

With reference to FIGS. 1-7(*b*), in various embodiments, threads may be provided along the inner peripheral surface of the second hole (e.g., 17, 67, 85) for mating (e.g., screwing) with corresponding threads of the fastening member (e.g., 31, 86). In other embodiments, one or more of the second hole and the fastening member may be free of threads.

In various embodiments, the fixing device (e.g., 10, 60, 80) may include one each of the locking arm (e.g., 16) and the second hole (e.g., 17, 67, 85). In other embodiments, the fixing device may include any number of locking arms and/or second holes. In other embodiments, either of the locking arm and the second hole may be omitted.

In various embodiments, the locking arm (e.g., 16) of the fixing device (e.g., 10, 60, 80) may protrude from the base-side of the wall (e.g., 11, 61, 81), and the shell (e.g., 2, 53) may include the locking aperture (e.g., 20 for receiving the locking arm of the fixing device. In other embodiments, the shell may include the locking arm, and the fixing device may include the locking aperture for receiving the locking arm of the shell.

In various embodiments, the wall (e.g., 11, 61, 81) of the fixing device (e.g., 10, 60, 80) may be configured to contact the shell (e.g., 2, 53). In other embodiments, at least a portion of the wall of the fixing device (e.g., only a portion of the wall) may be configured to contact the shell.

In various embodiments, the base (e.g., 12, 62, 82) of the fixing device (e.g., 10, 60, 80) may be arranged to contact the shell (e.g., 2, 53). In other embodiments, the base of the fixing device need not contact the shell. In other embodiments, at least a portion of the base of the fixing device (e.g., only a portion of the base) may be arranged to contact the shell.

In various embodiments, an angle of the wall (e.g., 11, 61, 81) of the fixing device (e.g., 10, 60, 80) relative to the extension (e.g., 13, 63, 83) of the fixing device (e.g., 10, 60, 80) may be formed at a right angle to each other. In other embodiments, the angle of the wall of the fixing device relative to the extension of the fixing device may be any suitable angle. For example, the angle may be more than 90 degrees to account for any bending that may occur from operating the coupling device (e.g., 20, 70).

In various embodiments, the fixing device (e.g., 10, 60, 80) may include the first hole (e.g., 15, 65, 84), and the insertion member (e.g., 23*a*, 74) may be provided in the coupling device (e.g., 20, 70). In other embodiments, the coupling device may include the first hole, and the extension of the fixing device may include the insertion member to allow the coupling device to operatively connect with the extension of the fixing device.

In various embodiments, the fixing device (e.g., 10, 60, 80) may be formed with a plate material. In other embodiments, the fixing device may be any suitable rigid structure, such as (but not limited to) a rod and/or the like.

In various embodiments, the head portion (e.g., 24*a*) of the bolt member (e.g., 24) may have a convex spherical shape. In other embodiments, the head portion of the bolt member may have a concave spherical shape, a conical shape, a pyramidal shape, or the like.

In various embodiments, the head portion (e.g., 24*a*) of the bolt member (e.g., 24) may include ribs that protrude radially wherein heights of the ribs relative to the axial direction of the insertion portion (e.g., 23*a*) decreases as the ribs become further from a center position of the insertion portion. In such embodiments, the insertion portion may retain a common axis with the rod member while an angle of the extension (e.g., 13, 83) of the fixing device (e.g., 10, 80) relative to the insertion portion changes from the force of the coupling device (e.g., 20, 70) acting upon it.

In various embodiments, the insertion portion (e.g., 23*a*) and the first hole (e.g., 15, 65, 84) of the fixing device (e.g., 10, 60, 80) may have a shape of a hexagon. In other embodiments, the insertion portion and the first hole of the fixing device may have any suitable shape, including, but not limited to, that of a triangle, ellipse, and/or the like.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A drum comprising:

a tubular shell;

a head stretched across a first end of the shell;

a hoop configured to hold down an outer peripheral edge of the head;

a plurality of fixing devices arranged along a second end of the shell; and a plurality of coupling devices operatively connecting the plurality of fixing devices with the hoop, the plurality of coupling devices configured to stretch the head;

wherein each of the plurality of fixing devices includes a wall, a base, and an extension, the wall of the fixing device fixed to a wall section of the shell, the base of the fixing device protruding from the wall of the fixing device, the base of the fixing device arranged adjacent the second end of the shell, the extension of the fixing device extending from the base of the fixing device so as to extend beyond an outer periphery of the shell, the extension of the fixing device operatively connected with an end of a respective coupling device of the plurality of coupling devices.

2. The drum of claim 1, wherein the wall of the fixing device is in contact with an inner peripheral surface of the shell.

3. The drum of claim 1, the fixing device having an attachment hole in the wall for receiving a fastening member;

the fixing device having a locking arm insertable into a specified location of the shell;

the shell having an insertion hole aligned with the attachment hole of the fixing device in a case where the fixing device is arranged on the shell;

the shell having a locking aperture into which the locking arm of the fixing device is insertable.

4. The drum of claim 1, wherein at least one of the extension of the fixing device and the respective coupling device has an attachment hole;

the drum further comprising:

an insertion member of the other of the at least one of the extension of the fixing device and the respective coupling device including the insertion member, the insertion member provided in the attachment hole;

a fall-out prevention member, the fall-out prevention member having a diameter that gradually increases in an axial direction from the insertion member, the fall-out prevention member having a diameter greater than a diameter of the attachment hole;

wherein a space is provided between the insertion member and an edge defining the attachment hole of the fixing device in a direction perpendicular to an axial direction of the shell; and wherein the respective coupling device is configured to be fastened to the hoop by rotation of a threaded rod.

5. The drum of claim 1, the drum further comprising:

a cover for covering the second end of the shell, the base of the fixing device, and the extension of the fixing device, the cover made of a flexible material.

6. A percussion instrument, the percussion instrument comprising:

a shell;

a head stretched across a first end of the shell;

a hoop member configured to hold down the head;

a plurality of fixtures, each of the plurality of fixtures arrangeable along at least two surfaces of the shell;

a plurality of adjustment devices configured to stretch the head, each of the plurality of adjustment devices for operatively connecting one of the plurality of fixtures with the hoop member;

a frame provided in the shell; and a sensor arranged on the frame to sense a vibration on the head.

7. A percussion instrument, the percussion instrument comprising:

a shell;

a head stretched across a first end of the shell;

a hoop member configured to hold down the head;

a plurality of fixtures arrangeable along at least two surfaces of the shell; and a plurality of adjustment devices configured to stretch the head, each of the plurality of adjustment devices for operatively connecting one of the plurality of fixtures with the hoop member;

wherein each of the plurality of fixtures comprises:

a wall arrangeable on the shell;

a base protruding from the wall, the base arrangeable on the second end of the shell; and an extension extending from the base beyond an outer periphery of the shell, the extension for operatively connecting with one of the plurality of adjustment devices.

8. The percussion instrument of claim 7, wherein the base of the fixture is substantially perpendicular to the wall of the fixture.

9. The percussion instrument of claim 7, wherein the wall of the fixture is in contact with an inner peripheral surface of the shell in a case where the fixture is arranged on the shell.

10. The percussion instrument of claim 7, the percussion instrument further comprising:

a cover for covering the second end of the shell, the base of the fixture, and a portion of the extension of the fixture.

11. The percussion instrument of claim 10, wherein the cover is made of a flexible material.

12. The percussion instrument of claim 7, the wall of the fixture comprising a first wall;

the fixture further comprising a second wall extending from the extension, the second wall operatively connected with the adjustment device.

13. The percussion instrument of claim 12, at least one of the second wall of the fixture and the adjustment device having an attachment hole;

the other of the at least one of the second wall of the fixture and the adjustment device, relative to the at least one of the second wall of the fixture and the adjustment device, having an arm insertable in the attachment hole to connect the adjustment device with the fixture.

14. The percussion instrument of claim 7, wherein the wall of the fixture is in contact with an outer peripheral surface of the shell in a case where the fixture is arranged on the shell;

wherein the base of the fixture extends in a direction away from the outer peripheral surface of the shell; and wherein the extension of the fixture extends away from the base of the fixture in a direction substantially opposite from the base of the fixture.

15. The percussion instrument of claim 14, wherein the wall of the fixture is arranged in a recess provided on the outer peripheral surface of the shell.

16. The percussion instrument of claim 6, at least one of the fixture and the shell having a locking aperture;

at least one of the fixture and the shell having a locking member insertable into the locking aperture.

17. The percussion instrument of claim 6, the fixture configured to be attached to the shell.

18. A percussion instrument, the percussion instrument comprising:

a shell;

a head stretched across a first end of the shell;

a hoop member configured to hold down the head;

a plurality of fixtures arrangeable along at least two surfaces of the shell; and a plurality of adjustment devices configured to stretch the head, each of the plurality of adjustment devices for operatively connecting one of the plurality of fixtures with the hoop member;

the fixture configured to be attached to the shell;

the shell having an insertion hole;

the fixture having an attachment hole aligned with the insertion hole of the shell in a case where the fixture is arranged on the shell;

the percussion instrument further comprising a fastening member insertable into the insertion hole of the shell and the attachment hole of the fixture to attach the fixture to the shell.

19. The percussion instrument of claim 6, wherein the adjustment device comprises an adjustable rod member for stretching the head.

20. A percussion instrument, the percussion instrument comprising:

a shell;

a head stretched across a first end of the shell;

a hoop member configured to hold down the head;

a plurality of fixtures arrangeable along at least two surfaces of the shell; and a plurality of adjustment devices configured to stretch the head, each of the plurality of adjustment devices for operatively connecting one of the plurality of fixtures with the hoop member;

at least one of the fixture and the adjustment device having an attachment hole;

the other of the at least one of the fixture and the adjustment device, relative to the at least one of the fixture and the adjustment device, having a portion configured to be retained in the attachment hole;

the percussion instrument further comprising a fastening member fastened to the portion of the other of the at least one of the fixture and the adjustment device to retain the portion of the at least one of the fixture and the adjustment device in the attachment hole.

21. The percussion instrument of claim 20, the fastening member having a head portion with a diameter greater than a diameter of the attachment hole.

22. The percussion instrument of claim 20, wherein the fixture has the attachment hole; and wherein a space is provided between the insertion member and an edge defining the attachment hole of the fixture in a direction perpendicular to an axial direction of the shell.

23. A percussion instrument, the percussion instrument comprising:

a shell;

a head stretched across a first end of the shell;

a hoop member configured to hold down the head;

a plurality of fixtures arrangeable along at least two surfaces of the shell; and a plurality of adjustment devices configured to stretch the head, each of the plurality of adjustment devices for operatively connecting one of the plurality of fixtures with the hoop member;

wherein the at least two surfaces comprises a bottom surface of the shell and one of an inner peripheral surface and an outer peripheral surface of the shell.

24. A method of manufacturing a percussion instrument, method comprising:

providing a shell;

stretching a head across a first end of the shell;

configuring a hoop member to hold down the head;

arranging each of a plurality of fixtures along at least two surfaces of the shell;

providing a plurality of adjustment devices configured to stretch the head, each of the plurality of adjustment devices for operatively connecting one of the plurality of fixtures with the hoop member;

providing a frame in the shell; and arranging a sensor on the frame to sense a vibration on the head.

25. The percussion instrument of claim 6, each of the plurality of fixtures having a first surface arranged on a first side of the shell and a second surface arranged on a second side of the shell to face the first surface.

26. The percussion instrument of claim 25, wherein each of the plurality of fixtures is formed as a single unit.

27. The percussion instrument of claim 6, wherein the at least two surfaces comprise an inner peripheral surface of the shell and a second end of the shell opposite the first end of the shell.

28. The percussion instrument of claim 6, wherein the at least two surfaces comprise an outer peripheral surface of the shell and a second end of the shell opposite the first end of the shell.

29. The percussion instrument of claim 6, wherein each of the plurality of fixtures are arrangeable on the shell so as not to protrude through an outer peripheral surface of the shell.

30. The percussion instrument of claim 6, wherein each of the plurality of fixtures are arrangeable to be spaced apart from an outer peripheral surface of the shell.

31. A percussion instrument, comprising:

a shell;

a head stretched across a first end of the shell;

a hoop member configured to hold down the head;

a plurality of fixtures, each of the plurality of fixtures arranged adjacent at least two surfaces of the shell;

a plurality of adjustment devices configured to stretch the head, each of the plurality of adjustment devices for operatively connecting one of the plurality of fixtures with the hoop member;

a frame provided in the shell; and a sensor arranged on the frame to sense a vibration on the head.

* * * * *